US006658760B2

(12) United States Patent
Kohlman et al.

(10) Patent No.: US 6,658,760 B2
(45) Date of Patent: Dec. 9, 2003

(54) BAG FOR HOME DRY CLEANING PROCESS

(75) Inventors: Randolph S. Kohlman, Boiling Springs, SC (US); Allan W. Smith, Gaffney, SC (US); Thomas E. Godfrey, Moore, SC (US); Charles E. Willbanks, Spartanburg, SC (US); Allen M. Smith, Roebuck, SC (US)

(73) Assignee: Milliken & Company, Spartanburg, SC (US)

( * ) Notice: Subject to any disclaimer, the term of this patent is extended or adjusted under 35 U.S.C. 154(b) by 0 days.

(21) Appl. No.: 10/078,181

(22) Filed: Feb. 19, 2002

(65) Prior Publication Data

US 2002/0112365 A1 Aug. 22, 2002

Related U.S. Application Data

(63) Continuation of application No. 09/478,875, filed on Jan. 7, 2000.

(51) Int. Cl.[7] ..... F26B 7/00; F26B 25/06

(52) U.S. Cl. ..... 34/311; 34/307; 34/201; 34/309; 8/142; 383/119

(58) Field of Search ..... 34/307, 309, 201, 34/311, 380, 381, 442; 8/137, 142; 510/515, 520; 383/117, 119

(56) References Cited

U.S. PATENT DOCUMENTS

| | | | | | |
|---|---|---|---|---|---|
| 2,426,843 | A | * | 9/1947 | Phair et al. | 8/137 |
| 3,151,345 | A | * | 10/1964 | Massop | 8/150 |
| 3,422,867 | A | * | 1/1969 | Wu | 150/3 |
| 3,738,565 | A | * | 6/1973 | Ackley et al. | 229/55 |
| 4,630,312 | A | * | 12/1986 | Milstein | 383/86 |
| 4,974,967 | A | | 12/1990 | Tsuyoshi et al. | 383/97 |
| 5,082,466 | A | * | 1/1992 | Rubenstein et al. | 8/142 |
| 5,238,587 | A | | 8/1993 | Smith et al. | 252/8.6 |
| 5,547,476 | A | | 8/1996 | Siklosi | 8/142 |
| 5,591,236 | A | | 1/1997 | Roetker | 8/137 |
| 5,630,847 | A | | 5/1997 | Roetker | 8/137 |
| 5,630,848 | A | | 5/1997 | Young et al. | 8/137 |
| 5,658,651 | A | | 8/1997 | Smith et al. | 442/59 |
| 5,681,355 | A | | 10/1997 | Davis et al. | 8/137 |
| 5,687,591 | A | | 11/1997 | Siklosi | 68/212 |
| 5,746,776 | A | | 5/1998 | Smith et al. | 8/142 |
| 5,762,648 | A | | 6/1998 | Yeazell | 8/137 |
| 5,789,368 | A | | 8/1998 | You et al. | 510/297 |
| 5,840,675 | A | | 11/1998 | Yeazell | 510/439 |
| 5,863,299 | A | | 1/1999 | Holt et al. | 8/142 |
| 5,865,851 | A | | 2/1999 | Sidoti et al. | 8/142 |
| 5,872,090 | A | | 2/1999 | You et al. | 510/284 |
| 5,876,462 | A | | 3/1999 | Weller et al. | 8/142 |
| 5,908,473 | A | | 6/1999 | Weller et al. | 8/142 |
| 5,951,716 | A | | 9/1999 | Lucia, III et al. | 8/142 |
| 5,965,504 | A | | 10/1999 | Reynolds | 510/285 |
| 5,972,041 | A | | 10/1999 | Smith et al. | 8/142 |
| 5,997,586 | A | | 12/1999 | Smith et al. | 8/142 |
| 6,010,540 | A | | 1/2000 | Telesca et al. | 8/142 |
| 6,024,767 | A | | 2/2000 | Telesca et al. | 8/142 |
| 6,036,727 | A | | 3/2000 | Smith | 8/142 |

FOREIGN PATENT DOCUMENTS

| | | | |
|---|---|---|---|
| GB | 2302553 | 6/1996 | D06F/43/00 |
| WO | WO 0037733 | 12/1998 | D06F/95/00 |

* cited by examiner

*Primary Examiner*—Ira S. Lazarus
*Assistant Examiner*—K. B. Rinehart
(74) *Attorney, Agent, or Firm*—Terry T. Moyer; George M. Fisher

(57) ABSTRACT

A flexible container in the form of a bag is described for use in a non-immersion dry cleaning process. Bag walls that are appropriately stiff and slick are preferred (preferred Kawabata Evaluation System stiffness and surface friction values are given), as are bag designs that are inherently three-dimensional and self-supporting. A preferred embodiment is a tetrahedral bag having a slick polymeric coating on the interior surface.

16 Claims, 7 Drawing Sheets

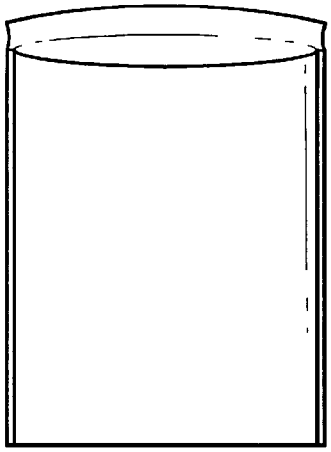
FIG. –1A–
PRIOR ART
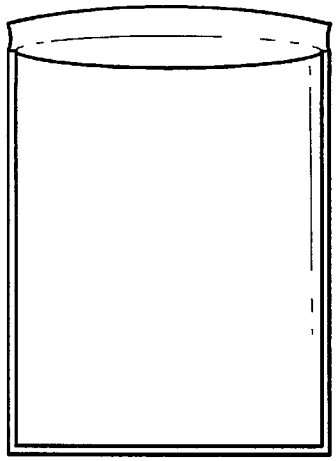
FIG. –1B–
PRIOR ART
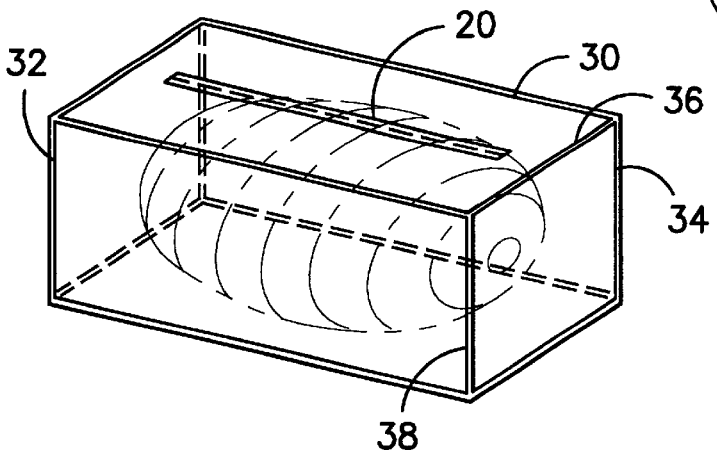
FIG. –2–
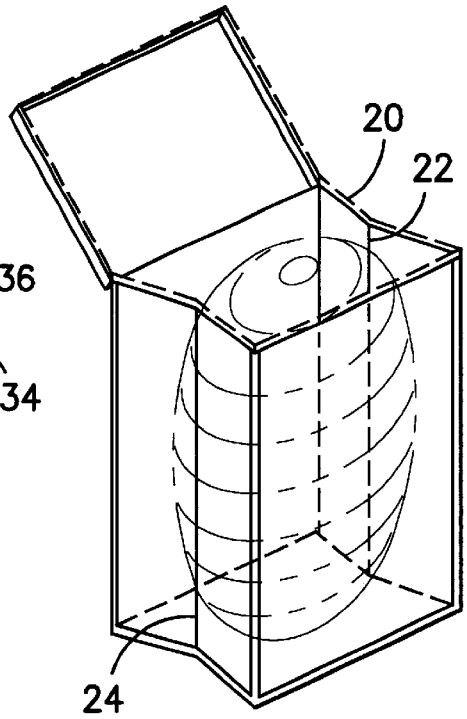
FIG. –3–

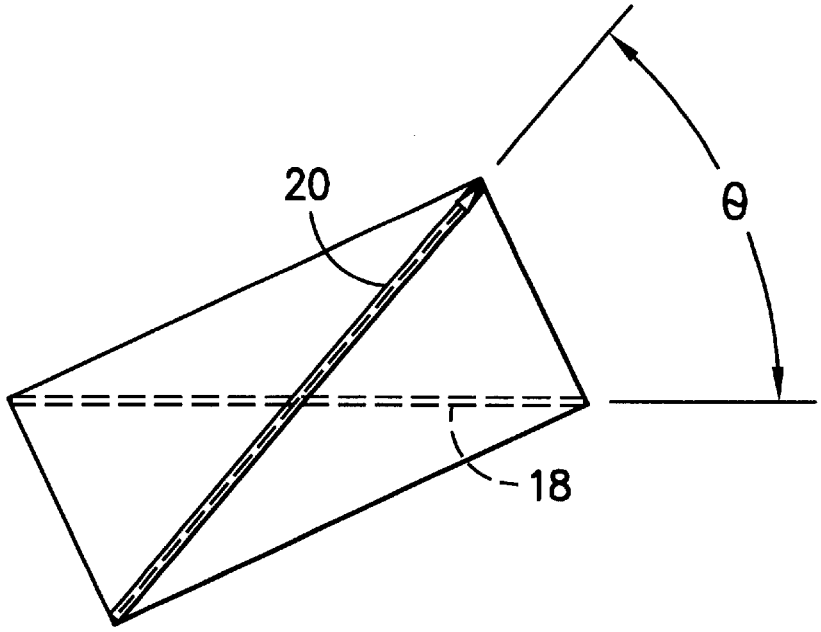
FIG. –9–
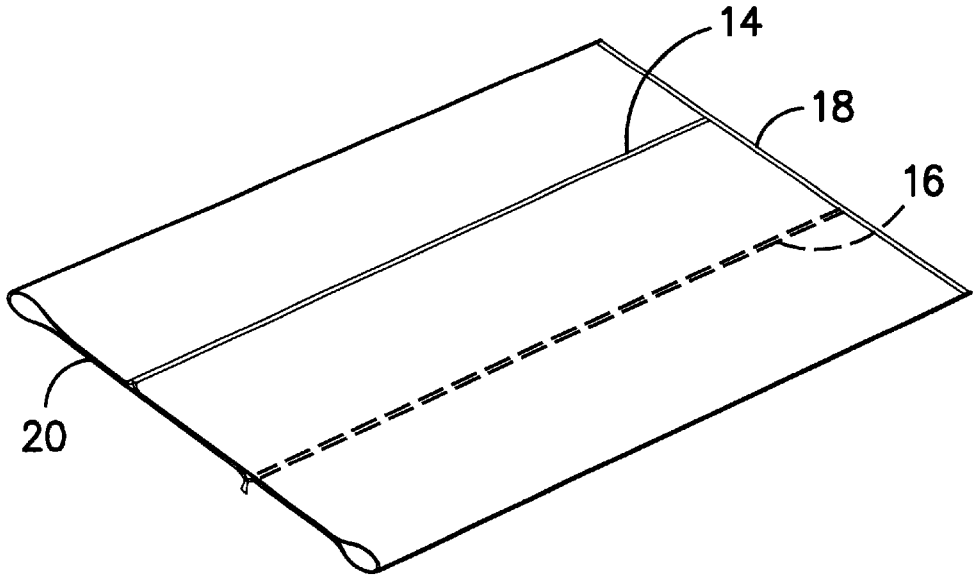
FIG. –10–

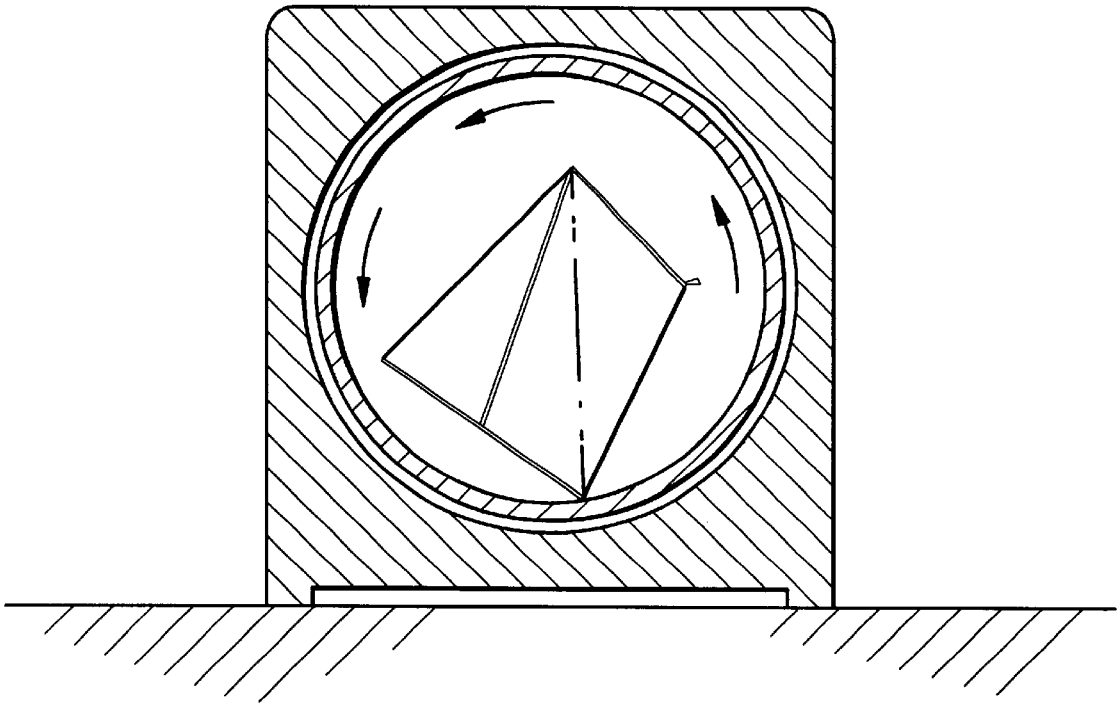
FIG. –13–

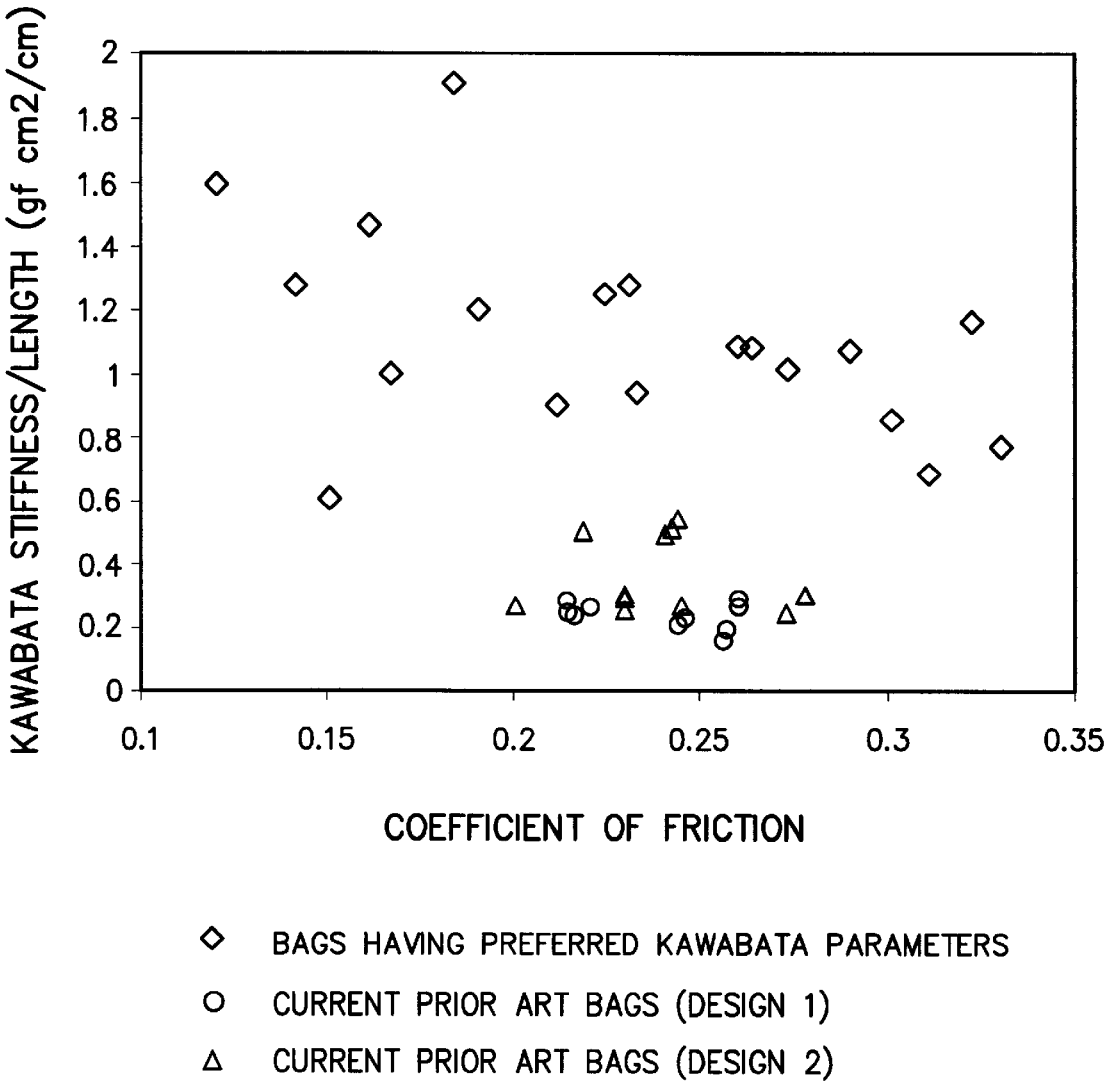
*FIG. —14—*

BAG FOR HOME DRY CLEANING PROCESS

This application is a continuation of U.S. patent application Ser. No. 09/478,875, filed on Jan. 7, 2000, on behalf of Randolph S. Kohlman; Allan W. Smith; Thomas E. Godfrey; Charles E. Willbanks; Allen M. Smith for BAG FOR HOME DRY CLEANING PROCESS, which is incorporated by reference herein in its entirety.

TECHNICAL FIELD

This disclosure relates to flexible containers, and sheet materials from which such containers may be constructed, that may be used in connection with non-immersion dry cleaning processes, and particularly those that take place within a heated clothes dryer. This disclosure includes a description of certain reusable flexible containers in the form of bags in which garments or other articles to be cleaned using such processes may be brought into operative contact with a cleaning agent in a way that (1) encourages efficient, thorough and uniform cleaning or freshening of the articles, and (2) removes, as well as discourages the formation of, wrinkles from the articles. This disclosure further includes a description of certain preferred mechanical performance features associated with such bags.

BACKGROUND

Water-based laundering and non-aqueous-based dry cleaning processes are fundamentally different, but both are commonly used to clean certain kinds of textile fabrics found in the home. Each process is generally capable of removing soil and odors and imparting the fabrics with a clean, fresh appearance and fragrance. However, in many instances, laundering cannot be used because of the likelihood of undesirable consequences, such as differential shrinkage of the garment's constituent materials, which can cause garment distortion, seam puckering, and distortion of sensitive fabric surface patterns. Additionally, laundering can cause the undesirable bleeding or blending of dyes on a fabric that can affect not only that fabric but other fabrics being laundered at that time. Furthermore, some oily soils are not readily removed by laundering.

Because of these characteristics of laundering, some textile products require a non-aqueous dry cleaning process for satisfactory cleaning. Traditionally, such dry cleaning processes have been solvent immersion-type processes that are available only at commercial or industrial facilities, and have been relatively costly, time consuming, and inconvenient when compared with home laundering. However, these disadvantages have been considered inevitable consequences of having to clean "dry clean only" textile articles.

Recently, various processes have been developed by which the advantages of dry cleaning can be achieved in a cleaning system that uses the drying cycle of an ordinary residential clothes dryer. These processes, which rely upon the movement of cleaning vapors or gases (these two terms shall be used interchangeably herein) and which are roughly analogous to steam distillation processes, vary in terms of the formulation of the cleaning composition to be used and other details, but generally share common features.

Among these features is the use of a container, most frequently a bag, within which the textile articles and the cleaning composition or agent (these two terms shall be used interchangeably) are brought into operative contact. The articles and a cleaning composition or agent are placed in the bag (the cleaning agent may have a separate receptacle within the bag, and even may already be present in the bag), the bag opening is secured, and the bag is placed in a residential gas or electric clothes dryer. The heat and tumbling action associated with the drying cycle of the dryer causes the cleaning agent to volatilize or otherwise come into contact with the textile articles. The cleaning agent moistens and removes soils from the articles; it is also speculated that, in some cases, some soils on the articles may be at least partially volatilized by the heat from the dryer. In any case, the heat and motion imparted by the dryer promote the formation of a vapor or gas comprised of the cleaning agent and vaporized soil. This vapor is purged on a more-or-less continuous basis from the bag during the dryer cycle through vents or other gas-permeable areas associated with the bag.

Once outside the bag, the vapor-laden air is removed from the interior of the dryer in the same way moist air is removed during a regular drying cycle. The expelled vapors from inside the bag are replaced by relatively fresh, dry air from within the dryer. This process drives the non-equilibrium state in the bag in the direction of causing additional vaporization of cleaning agent and soil, which perpetuates the cleaning action until the cleaning agent is exhausted or the cleaning cycle is stopped. For purposes of discussion herein, such processes will be referred to as non-immersion dry cleaning processes or, more simply, as dry cleaning processes. Although the process is described in terms of a home dry cleaning process using a residential clothes dryer, it is contemplated that the bag construction principles described herein can be used advantageously in similar non-immersion dry cleaning processes that are done in a commercial setting, using commercial or industrial-sized dryers and loads, with bags that are appropriately sized and constructed to accommodate larger loads, extended repeated use, or other commercial requirements.

The design and mechanical performance of the container or bag can have a dramatic effect on the results of these non-immersion dry cleaning processes. Assuming that a bag has the requisite heat resistance and durability, a preferred bag has two fundamental characteristics: (1) an internal space (in terms of both size and shape) capable of providing and maintaining a desirable free tumbling volume (as defined herein) appropriate for the volume of articles to be cleaned, and (2) a satisfactory mechanism to effect and promote a substantially continuous exchange of gases into and out of the bag as the cleaning cycle progresses.

If the bag, while being tumbled by the dryer, has an interior size and shape that promotes full and unencumbered tumbling of the individual articles in the bag, the articles are much more likely to be exposed to the cleaning agent and be cleaned in a thorough and wrinkle-free way. Additionally, because of the essential role that the cleaning vapors have on the efficacy of the process, the articles are much more likely to be cleaned satisfactorily if the bag promotes the proper exchange of gases between the inside and outside of the bag during the cleaning cycle. However, excessive venting can lead to premature exhaustion of cleaning vapors. When this occurs, the supply of cleaning vapor is exhausted before the articles are sufficiently clean and before the cleaning cycle is complete. It is speculated that this may cause the interior of the bag to overheat, may lead to unacceptable shrinkage of the articles being cleaned, and may encourage the setting of wrinkles in such articles.

However, if the bag is to deliver superior cleaning performance, the intrinsic venting characteristics of the bag are merely one of several variables, including the shape of the interior volume, the slickness of the interior walls, the amount of cleaning composition, and the load size, that must be considered. We have found that, surprisingly, the establishment and maintenance of a satisfactory free tumbling space inside the bag when in use appears to affect both the unencumbered tumbling aspect and the gas exchange aspect—effective tumbling appears to be an important mechanism in both distributing and dispersing the cleaning agent among the articles to be cleaned, and, in conjunction with appropriate vents or other openings in the bag, in the exchange of gases between the inside of the bag and the inside of the dryer. We have additionally found that the geometric configuration of the bag, and the mechanical nature—in particular, the stiffness and slickness—of the wall material from which the bag is constructed, can have a dramatic effect on free tumbling space and the overall efficacy of the dry cleaning process. Specifically, durable bags that (1) have an appropriately sized and shaped interior volume, (2) are constructed from a design and with materials that provide an overall bag structure that is sufficiently stiff to substantially maintain the bag's interior configuration when in use, and (3) have an appropriately slick interior that encourages the desirable distribution of articles within the bag without promoting the collapse of the bag, have been found to be well suited for non-immersion dry cleaning use.

Of course, other characteristics must also be considered. For example, it is also desirable that the bag is easy and inexpensive to manufacture and easy to fold for marketing and storage purposes. Further desirable bag characteristics include (1) relatively high durability (including resistance to the high temperatures that could be encountered in a dryer), to allow re-use for a number of cleaning cycles, (2) relatively high use-to-use performance uniformity, to assure dependable and predictable cleaning results, (3) good practical appeal to the user—be easy to open and close, generate minimal noise during use, etc., and (4) good marketability and appeal for the supplier, for example, having a bag surface that provides a good texture or "feel" yet allows for the printing of trademarks, promotional or instructional messages, etc.

It is believed that bags designed and constructed in accordance with the teachings herein can have all the above characteristics, and can be advantageously employed, perhaps with modifications—for example, to accommodate the various means to supply the cleaning agents to the interior of the bag—in a variety of home or commercial non-immersion dry cleaning systems. Details and various embodiments of bags of this kind will be discussed in more detail in the following description, which refers to the drawings described briefly below.

DESCRIPTION OF FIGURES

FIG. 1A depicts a "flat" bag of the prior art having sewn or bonded side seams, an unseamed, folded bottom, and a flap-type closure associated with an otherwise open top.

FIG. 1B depicts a "flat" bag of the prior art having sewn or bonded side seams, a seamed bottom, and a flap-type closure associated with an otherwise open top.

FIG. 2 is a perspective view of a zippered bag in the form of a rectangular solid; the bag is depicted as containing an ellipsoid, as discussed herein.

FIG. 3 is a perspective view of a zippered bag in the form of a rectangular solid having pleats along one set of opposed sides, to facilitate the formation of a three-dimensional shape in use.

FIG. 9 is an end view of an alternative embodiment of the bag of FIG. 6, in which the angle formed by a projection of the opposing end seams is shown as θ, an angle that is substantially less than 90°.

FIG. 10 is a perspective view of the bag of FIG. 9, when empty, open, and lying flat, indicating the offset position of the end points of the zipper and the side seam, relative to the "bottom" of the bag (i.e., the seam opposite the zipper).

FIG. 13 is an elevation view of the bag of FIG. 6, as it would appear in a residential dryer drum, showing that the forces generated by the rotational motion of the dryer drum are not directed normal to a substantially flat surface, as might occur with the tumbling of a flat, inherently two-dimensional bag.

FIG. 14 is a diagram illustrating selected representative mechanical performance characteristics of several different sheet materials from which bag walls can be constructed.

DETAILED DESCRIPTION OF PREFERRED EMBODIMENTS

Definitions

Figure 4:
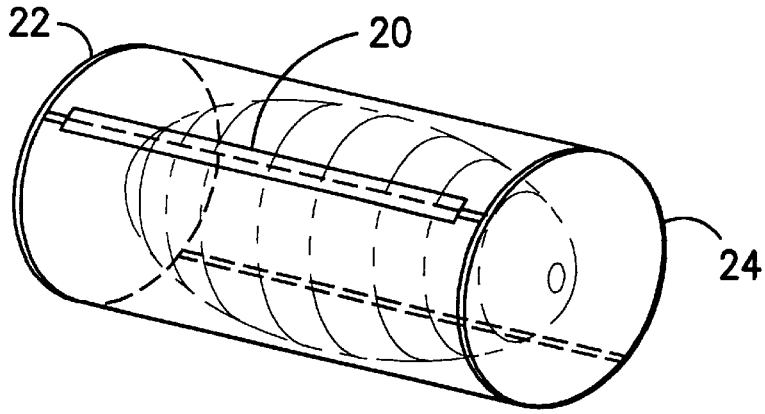
FIG. 4 is a perspective view of a zippered bag in the form of a cylinder; the bag is depicted as containing an ellipsoid, as discussed herein.

For purposes of the description herein, the following terms will have the indicated meaning.

The term "billow" or "billowing" shall refer to the expansion or inflation of the bag, usually as it is being tumbled within the dryer. The cause of billowing is sometimes described in the prior art as the pressure of the vaporized gases within the bag. We believe another, perhaps more important mechanism is the kinetic energy transfer from collisions between the articles in the bag and the bag walls, the latter being constructed of "engineered" sheet materials having the specific degree of stiffness, slickness, and controlled flexibility to allow full utilization of this kinetic energy transfer (see "kinetic resilience" herein). Billowing is considered important to the ability of a flexible bag to assume and maintain an internal volume or space that promotes free tumbling of articles in the bag.

The terms "crimping" and "creasing" shall refer to the tendency, during the dryer cycle, of some bag walls to deform and fold over onto themselves, either fully or partially, to a sufficient degree that some articles within the bag may undergo crease trapping, i.e., they may become isolated or trapped within the bag and the tumbling movement of those articles may become restricted.

The term "free tumbling volume" (also referred to as "FTV") shall refer to an estimate of that part of the total interior space or volume of the bag that is configured in a geometric shape that allows for articles inside the bag to tumble freely, without being trapped. That estimate may be measured using the concept of an enclosed ellipsoid, as discussed below.

The term "inherent structural rigidity" shall be used to describe a bag in which the stiffness or rigidity of the bag is attributable to properties or characteristics of the bag wall, as well as various support elements that are associated with the bag wall—for example, a seam or closure means that may or may not be reinforced—and that are permanent parts of the bag wall.

The term "inherently two-dimensional" shall refer to a bag having a geometric configuration such that, when the bag is empty and closed, it forms a substantially flat, structure with no need for overfolding.

The term "inherently three-dimensional" shall refer to a bag having a geometric configuration such that, when the bag is empty and closed, it forms an enclosed space and cannot be folded flat without overfolding (see below).

The term "kinetic pumping" shall refer to the outward displacement of vapor from within the bag and the inward drawing of relatively fresh, dry air from outside the bag. This term is intended to include the effects of (1) internal air displacements within the bag due to the movement of articles and (2) the impact of articles onto the interior surfaces of the bag, and (3) the impingement of the exterior surfaces of the bag against the dryer drum chamber that cause the bag walls to flex and undergo diaphragmatic movement. Although kinetic pumping is associated with distortions and the kinetic resilience (see below) of the bag wall, it is not necessarily associated with the relatively long term wall distortions arising from the formation of creases, folds, and the like that cause or contribute to trapping.

The term "kinetic resilience" shall refer to the deformable nature of the bag wall that allows cyclic volume changes of the bag in response to the tumbling action in the dryer. The effect of kinetic resilience is the propensity of the bag to use the internal impacts of the articles in the bag to billow and thereby preserve a free tumbling volume within the bag. Kinetic resilience also makes possible the diaphragmatic action associated with kinetic pumping, discussed above.

The term "overfolding" shall mean a fold that results in more than two layers of panel material, and shall be used in connection with folding the bag so as to make the bag lie substantially flat for storage or marketing purposes.

The term "self-supporting," as used to describe the bag disclosed herein, shall refer to the property of the bag, when the bag is empty and with all closing devices engaged, to maintain for extended periods a hollow, three-dimensional, free-standing shape, without significant sagging or buckling of the bag walls. An example of a self-supporting structure can be visualized by imagining a bag constructed of, for example, household aluminum foil wrap or other material that is somewhat stiff, yet flexible and readily configurable. As will be discussed in detail, the ability to assume and maintain an appropriately spacious interior in which the articles to be cleaned are able to tumble freely—a quality that self-supporting bags tend to have—appears to be important to good cleaning performance of the bag.

The term "slick" or "slickness" shall refer to a qualitative measure of the relative freedom from static or dynamic friction, as applied to a bag surface that carries a coating or film. It is synonymous with "slippery."

The term "soil" shall include both solid (visible or invisible) or vaporized contaminants, the latter contaminants including organic compounds and bacteria that contribute to a stale or otherwise unpleasant odor.

The term "stiff" or "stiffness" shall refer to the notion of the resistance to deformation resulting from the application of a steady force to a deformable medium, and shall be measured in terms of the Kawabata Bending Modulus, as defined herein. It should be noted that no attempt to distinguish bending stiffness from shear stiffness has been made in the following description, although it is recognized that buckling, and particularly buckling involving a coating that permeates a substrate, clearly may involve shear-type stiffness considerations. When referring to the overall "stiffness" of the bag or flexible container, the terms "rigid" or "rigidity" may be used, in keeping with the common usage of that term.

The general term "trapping" shall refer to the relative immobilization of a textile article within the bag, as might happen if (1) the article became wrapped or entangled with another article ("entanglement trapping"), (2) the article became caught in a crimp or crease in the bag due to the bending or buckling of the bag wall ("crease trapping"), or (3) the article became lodged in a corner of the bag ("corner trapping"). In any case, the free tumbling action of the article is adversely affected, and it is believed that, if the trapped condition persists, the cleaning effectiveness of the process for that article, and perhaps other articles in the bag as well, also will be adversely affected.

The term "venting" shall mean the exchange of gases between the inside and the outside of the bag. Specifically, it is thought that air containing both volatilized cleaning agent and volatilized soil passes out of the bag, and relatively clean, dry replacement air flows from the dryer interior into the bag, thereby causing the establishment of a non-equilibrium condition within the bag that can drive the further volatilization of the cleaning agent and soil.

For purposes of the following discussion, it shall be assumed that the bags are constructed of one or more panels, unless otherwise indicated. The terms "panels" and "walls," when referring to the sides of the bag, shall be used interchangeably and may refer to continuous, seamless constructions (e.g., blown or molded films) as well as constructions assembled from several discrete components (e.g., several sewn fabric panels), unless otherwise noted.

The use of headings as part of this description is for convenience only; these headings are not intended to be limiting or controlling in any way.

Containment Basics of the Prior Art

FIGS. 1A and 1B show typical constructions of dry cleaning bags of the prior art. These inherently two-dimensional bags are constructed using various conventional construction techniques, with a variety of flexible sheet materials, such as polymer sheets, nylon films, and coated textile fabrics. However, as will be discussed in more detail below, we have determined that these sheet materials may not have the combination of mechanical properties—specifically, the stiffness and surface friction characteristics—to assure consistent effective performance in non-immersion dry cleaning processes.

Typically, a square or rectangular section of such sheet material is folded at its midpoint onto itself, and the two opposed sets of free edges aligned and joined, leaving an opening opposite the fold. This results in a flat bag with a seam of conventional design along each of the sides, a fold along the bottom, and an opening at the top, which may include a flap or other feature (see FIG. 1A). Alternatively, the fold along the bottom may be replaced by a seamed edge, allowing the bag to be made from two separate panels of sheet material that are superimposed and seamed along three sides, leaving an opening along the fourth side (see FIG. 1B). In either case, seaming is accomplished by any conventional method, such as sewing, serging, gluing, fusing or heat sealing, or the like.

Inherently two-dimensional bags without seams have also been made for use in non-immersion dry cleaning applications by molding or otherwise forming a film of plastic or other material into a bag shape of the desired size. It has been found that such bags may not only fail to exhibit the desired mechanical properties discussed herein, but also may exhibit a high degree of variability with respect to wall thickness, wall rigidity, etc.

In each case, the bag has a securable opening into which the articles to be cleaned can be inserted. The securing means can be any conventional means, including, for example, zippers, snaps, hook-and-loop closing systems, bead and groove closures (e.g., similar to those used in household polymer film storage bags), various releasable adhesive systems, or a combination of these. Additional openings (and closures)—for example, to insert a cleaning agent into the bag—may also be present. In many cases, the securable opening also serves as a vent through which the cleaning vapors and relatively fresh air are exchanged during the cleaning process.

Inherently Two-dimensional Bags

The inherently two-dimensional bags of the prior art are designed to be inherently planar when empty—the bags consist essentially of two flat, congruent panels that are joined at the edges, as depicted in FIGS. 1A and 1B. There are no additional panels or panel portions that form separate sides, bottoms, or other surfaces, and, consequently, these bags, when empty and closed, generally can be made to lie flat with no significant bunching or gathering of the substrate material, and with no folding that results in more than a double layer of panel material, i.e., with no overfolding. Conversely, these bags are intended to assume a three-dimensional shape only when they contain articles to be cleaned, and then the shape they assume is generally dependent upon the mass and momentary configuration of the articles within the bag.

These bags generally have been found to lack the overall configuration and structural rigidity necessary to allow the bag, when empty and not in use, to assume a predetermined three dimensional shape without the need for physical pushing and pulling of the bag walls to impart the desired shape. Occasionally, such bags will be designed to accommodate removable rigid rings or the like to assist in the formation or maintenance of a three-dimensional shape during use, such as is disclosed in U.S. Pat. No. 5,951,716 to Lucia, III, et al. Such rings, however, are optional additions that can be accommodated by the bag at the discretion of the user, and are not inherent structural elements of the bag itself. Accordingly, such removable structures are not considered to impart to the bags inherent structural rigidity, as that term has been defined herein, and, because such bags remain inherently planar without such structures, do not render such bags inherently three-dimensional.

The Importance of Free Tumbling Volume

As a result of these deficiencies, it has been found that, in use during the dry cleaning process discussed herein, these prior art bags can fail to assume and maintain a desirable free tumbling volume, as that term is defined herein, that satisfactorily provides for the proper distribution of cleaning agent on the articles to be cleaned and the efficient exchange of gases into and out of the bag. These deficiencies have been found to compromise the uniformity and effectiveness of the cleaning process. In particular, the essentially planar bags of the prior art can undergo severe buckling and folding that extend across at least a portion of the width of the bag, thereby causing the bag to "compartmentalize" and behave like two or more separate, smaller bags. When this occurs, both the distribution of cleaning agent within the bag and the exchange of gases into and out of the bag are adversely affected, which leads to compromised cleaning performance and to undesirably wrinkled articles.

As discussed above, bags of the prior art are typically constructed by the edgewise joining of two congruent, superimposed rectangular panels (See FIGS. 1A and 1B). When such bag is empty and closed, this design almost always results in the formation of a substantially planar structure that defines no significant interior space under ordinary circumstances—it is an inherently "flat," two-dimensional structure. Effective cleaning performance in a bag depends upon the success with which the bag can billow during use, and in doing so create or maintain a three-dimensional internal space in which the articles to be cleaned can tumble freely. To meet this requirement and avoid a constricted interior space, the inherently two-dimensional bags of the prior art depend substantially upon the kinetic resilience of the bag wall and the kinetic energy transfer from the mass of the articles inside the bag to the bag walls, as the articles impact and outwardly displace the bag walls as the bag is being tumbled in the dryer. This issue is of particular interest in situations in which the mass of articles to be cleaned is low. In such cases, if the bag wall has sufficient stiffness to resist buckling, the articles may have insufficient mass to billow the bag wall.

It is interesting to note that this billowing mechanism is somewhat recursive, in the sense that (1) having free tumbling space promotes the appropriate transfer of kinetic energy to the bag walls; (2) that transfer of energy causes outward wall displacement; (3) outward wall displacement maintains the free tumbling space within the bag. If the wall is unable to be displaced outwardly, relative to the interior of the bag, by the articles inside the bag, the interior space of the bag tends to collapse.

Bags Having Inherent 3-D Configurations

A three dimensional bag configuration that will promote the formation of an effective tumbling volume may be achieved by constructing a bag having an inherently non-planar configuration, i.e., a bag that, when empty and at least when closed (i.e., the closure device is engaged), cannot be made substantially flat without overfolding. Many different bag configurations can be constructed that take on a three-dimensional shape when in an expanded or billowed form, such as, for example, spherical or hemispherical shapes, various conical or polyhedral shapes (e.g., opposed cones, joined at the base), or shapes derived from such shapes. In general, all such shapes can be classified as general prismatoids, i.e., solids defined by the property that the area $A_y$ of any section parallel to and at distance y from a fixed plane can be expressed as a polynomial in y of degree $\leqq 3$. In other words, $$A_y = a \cdot y^3 + b \cdot y^2 + c \cdot y + d$$

where a, b, c, and d are constants that may be positive, negative, or zero.

However, all such shapes may not be capable of defining an enclosed space that would provide a satisfactory free tumbling volume ("FTV"). It is important that the space enclosed by the bag, even if the space has substantial volume, have a configuration that will promote the free tumbling of articles within the bag.

As a separate consideration, non-immersion dry cleaning bags should have (but often lack) sufficient wall rigidity to resist and avoid large-scale wall folding, creasing, and buckling, all of which tend to isolate or compartmentalize portions of the bag interior, and which are frequently associated with poor cleaning performance. Although the corner portions of all bags are vulnerable to such folding and buckling, this condition is observed to affect with particular severity the main body of inherently two-dimensional bags. When tumbled in a dryer, such bags often become oriented in the dryer in a position in which the rotational energy of the dryer drum imparts a buckling force to the panels in the direction perpendicular to the plane of the panels. This force, particularly when applied to articles that have become clumped inside the bag, can cause the bag to develop significant buckling, which is often accompanied by the formation of creases that extend across the bag and effectively "pinch" the bag into two or more isolated sections. The inherent stiffness of the panels is frequently ineffective in preventing such buckling, and bag compartmentalization and poor cleaning performance result. It has been observed that inherently three-dimensional bags, and particularly bags that have sufficient structural stiffness to be self-supporting, tend to be effective in resisting such buckling.

Corner Crushing

Another condition that can have a significant impact on cleaning performance is the phenomenon of "corner crushing"—the tendency for the protruding corners or edges of bags to collapse as a result of contact with the interior of the dryer drum. Corner crushing reduces the volume of the interior of the bag by constructively eliminating much of the volume associated with the corners of the interior space. Corner crushing has somewhat contrary effects: while the interior space becomes smaller, thereby reducing the internal volume in which the articles may tumble, the resulting smaller space becomes more "compact" (generally becoming more sphere-like) and, therefore, less likely to encourage the trapping of articles. As a result, the overall effect of corner crushing on the cleaning process can be positive, so long as articles do not get trapped in the corner areas during the crushing process. As will be discussed below, techniques can be used to encourage corner crushing (e.g., the application of a coating to the bag wall), as well as to discourage the migration of articles into the corner areas (e.g., the truncating of corner areas using a seam or the like).

Assessing Interior Space and Free Tumbling Volume

It is useful to consider carefully the shape of the space enclosed by the bag that is unimpeded by constrictions or closely-spaced bag walls, and that is available for free tumbling when the bag is empty and fully billowed. In attempting to define this free tumbling space, it is also useful to recognize the particular tendency for certain geometric shapes to undergo corner crushing. To assess the free tumbling volume afforded by a given bag, assuming that corner crushing will occur, it is convenient to use the interior space defined by an enclosed ellipsoid that is just large enough to fit inside the bag. Ideally, the more sphere-like the interior space is, the more it will allow for the free tumbling of articles placed within that space. Use of an ellipsoid as the measure preserves the basic ideal of a sphere, but allows some compensation for interior shapes that, while not spherical, geometrically will allow significant unencumbered tumbling of articles, as would occur in a non-spherical bag design in which corner crushing had occurred.

Ellipsoids can be formed by the rotation of an ellipse about one of the semi-axes. The volume of an ellipsoid is $$V=(4/3)\cdot\pi\cdot a\cdot b\cdot c$$

where a, b, and c are the lengths of the semi-axes. With respect to such semi-axes, the term "semi-axis ratio" shall refer to the ratio between the longest and the shortest of the semi-axes, and will serve as a rough measure of the relative compactness of the ellipsoid—the smaller the semi-axis ratio, the more "sphere-like" and the less "tube-like" or "slab-like" the ellipsoid. For purposes herein, a sphere will be simply defined as an ellipsoid in which the semi-axes are equal.

It has been found that this use of ellipsoids as a measure is most effective when the semi-axis ratio is held to a specified range, which is preferably between 1.0 and about 3.0, and more preferably between 1.0 and about 2.0, and most preferably between 1.0 and about 1.5. As discussed above, when the ratio is 1.0, the ellipsoid is, in fact, a sphere. These ranges are somewhat arbitrary, but are intended to prevent the interior bag configuration from becoming too "slab-like" or "tube-like," thereby defining a geometric space in which closely-spaced bag walls would inhibit free tumbling, particularly in cases of interior walls with textured surfaces or relatively high coefficients of friction. As discussed below, some of the adverse effects of closely-spaced walls may be offset by bag designs that incorporate stiff walls that have slick interior surfaces, thereby inhibiting buckling and trapping.

The term "free tumbling volume" or "FTV", may be thought of as the volume of the largest ellipsoid having a given semi-axis ratio that can "fit"—in a theoretical sense, with no stretching of the bag wall and with the only "contact" between the surface of the theoretical ellipsoid and the interior surfaces of the bag being at the points of tangency—within the space defined by the empty but fully expanded bag, when the bag is closed. The term "free tumbling volume index" (or, simply, "volume index") shall be defined as the ratio of the free tumbling volume to the total volume of the interior of the closed, empty, and fully expanded bag. This volume index will be a value between 0 and 1.0, with the value 1.0 representing a bag that has the desired ellipsoid-shaped interior, with no "wasted" space occupied by corners, etc. Values somewhat less than 1.0 indicate interiors that approximate an ellipsoid-shaped interior, with some corner areas that fall outside the boundaries of the specified theoretical ellipsoid. It is believed that volume index values of at least about 0.3, and preferably at least about 0.4, and more preferably at least about 0.5, and most preferably about 0.6 or more, yield the best FTVs.

A conventional two-dimensional bag with parallel sides and substantially no internal volume when empty may have a volume index value of substantially zero, unless manually billowed prior to measurement. It has been found that bags having low volume indices typically present increased opportunities for crease trapping and otherwise inefficient tumbling, and, consequently, tend to perform relatively poorly. The use of appropriately stiff, slick wall constructions often can significantly improve such performance.

The following discussion includes several specific inherently three-dimensional designs. It should be understood that the teachings of this disclosure concerning the advantages of three-dimensional designs, and the specific structural preferences disclosed herein, are not limited to these specific designs, but rather are applicable to all prismatoids that have the desired and necessary attributes for use as non-immersion dry cleaning bags. It should be noted that, in general, the designs discussed herein, and all other applicable prismatoid-based designs, tend to perform better when embodied in bags that are inherently self-supporting.

Specific 3-D Configurations—the Rectangular Bag

A bag that defines an internal volume resembling a rectangular solid with a semi-axis ratio of no more than about 3.0, as shown in FIG. 2, has reasonably good theoretical potential. Reducing the semi-axis ratio to 1.0 results in a rectangular solid more commonly referred to as a cube, a shape that should also yield good results. Access to the interior of the bag is provided by closure device 20, preferably a zipper, which may be located along an edge (for example, edge 30), or wholly within a panel, as shown. Trapping of articles in the corners of the bag is minimal due to the inherent "right angle" configuration of the corners, and, although the opposing planar bag walls are parallel, crimping and creasing of the bag walls can be minimized by adjusting the stiffness of the bag. This configuration can provide a relatively large free tumbling volume (depending upon the aspect ratio of the chosen rectangular solid), yet require relatively simple manufacturing. The configuration also can be made flat for marketing or storage purposes with relatively few, neat folds. Optionally, additional zippers (or other, different closure devices) can be used along the various edges (for example, 30, 32, 34, 36, and 38, and their counterparts at the opposite end of the bag) to facilitate folding this inherently three-dimensional design.

As indicated in FIG. 3, the ability to be easily folded can be assisted through the use of individual bag panels that are substantially rectangular in shape that may carry one or more pleats 22, 24 to assist in the formation of a suitably three-dimensional shape when the bag is fully opened, as well as to facilitate folding for storage purposes. Alternatively or additionally, one may use multiple openings in the bag that allow for the separation of individual panels, as, for example, having zippers installed along seam lines, to simplify the folding process, as indicated at 20 and discussed above.

Specific 3-D Configurations—the Cylindrical Bag

Similar to the rectangular bag discussed above, bags with favorable semi-axis ratios (i.e., no more than about 3.0) having internal volumes resembling cylinders (essentially, rectangles with circular cross-sections), as shown in FIG. 4, also demonstrate good theoretical potential. Trapping of articles in the corners of this bag is even less likely than with the rectangle, due to the lack of conventional corners. In further distinction, the cylinder has no planar parallel walls, having instead an inherently buckle-resistant circular cross-section. This configuration can also provide a relatively large free tumbling volume (depending upon the aspect ratio of the chosen cylindrical solid).

Manufacturing complexity is somewhat higher than for the rectangle, due to the need to cut, fit, and join the circular end portions, which, if the bag is to be stored as a two-dimensional structure (i.e., flat, with no overfolding), should be made to allow the end portions to be circumferentially disconnected from the tube-like main body of the bag. It is contemplated that zippers, a preferred closure means for the bags described above, would be preferred in this bag design as well, particularly in light of the teachings herein concerning the venting function that zippers can provide. Accordingly, a zipper is shown at 20. Optionally, an alternative or additional location for one or more zippers would be end seams 22, 24.

Specific 3-D Configurations—the "Rounded Tetrahedral" Bag

Figure 5A:
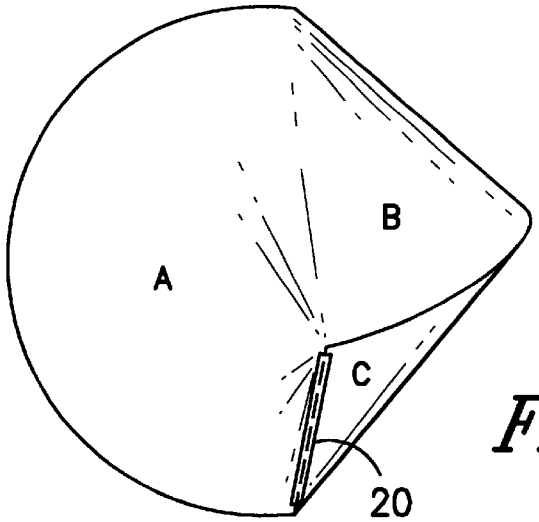
FIG. 5A is a perspective view of a zippered bag in the form of a rounded tetrahedron, as described herein.
Figure 5B:
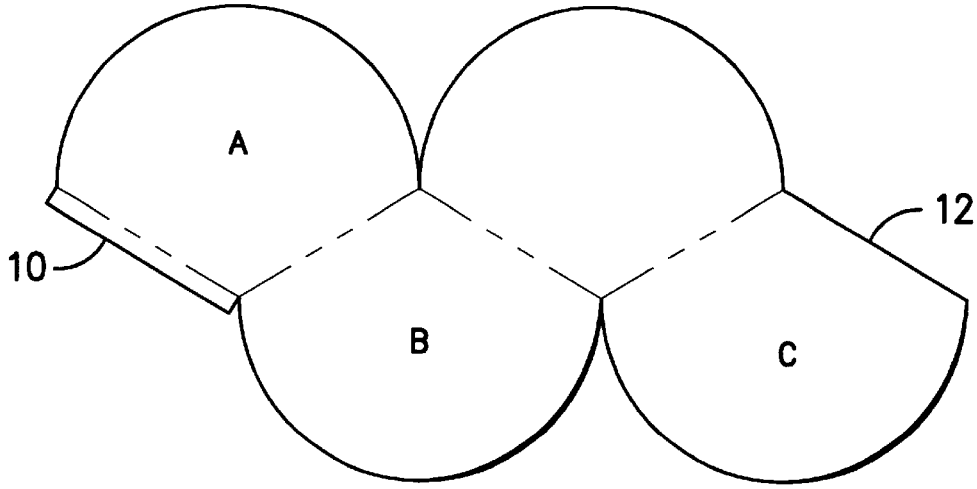
FIG. 5B is a representation of a pattern that could be used to cut out the sheet material used to construct the rounded tetrahedron of FIG. 5A.

An alternative, and highly unusual, shape that may be considered for use in non-immersion dry cleaning bags is one that is generated from two identical cones joined at the base. Bisecting this joined construction along a plane that contains both vertices will yield, for cones of the proper shape, a pair of solids having a square cross section on one side. If one of the "square" sides is rotated through 90° and joined to the other, non-rotated "square" side, the result is a shape that is reminiscent of a tetrahedron, but has curved rather than straight edges, as depicted in FIG. 5A (see, e.g., *Scientific American,* October, 1999, pages 116–117). A more practical method for constructing this solid from a web of sheet material is to use a pattern similar to that shown in FIG. 5B and fold the resulting geometric figure along the dashed lines so that tab 10 may be joined to straight edge 12. A suitable closure device, such as the zipper indicated at 20, can be installed along the resulting seam (e.g., along straight edge 12) or elsewhere.

The advantages of this design are a high inherent rigidity and a favorably shaped internal volume. The disadvantages of this shape are related to the extent to which manufacturing complexities are introduced by the use of a relatively complex pattern having curved edges and the need for a relatively complex folding and seaming process.

Specific 3-D Configurations—the Tetrahedral Bag

Figure 6:
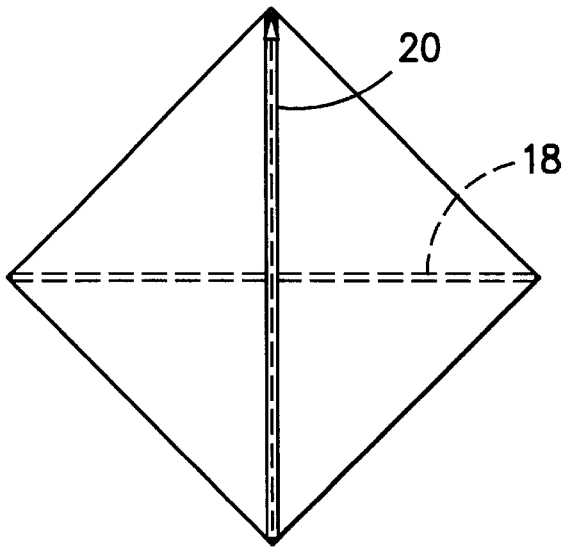
FIG. 6 is an end view of a bag in the shape of a tetrahedron; the angle formed by a projection of the opposing end seams is shown as 90°.
Figure 7:
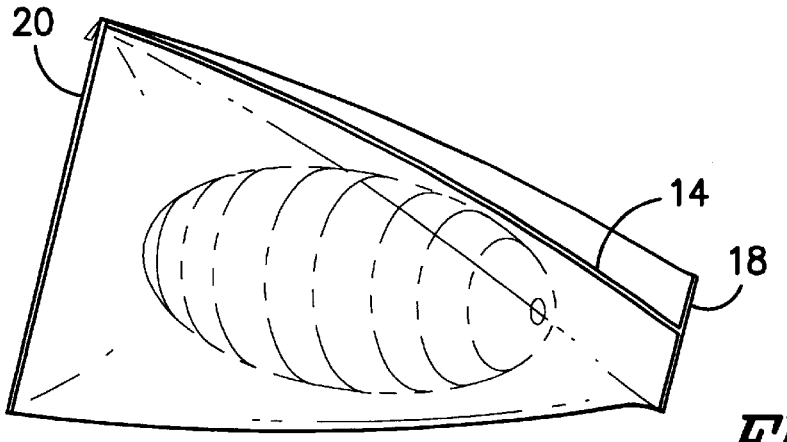
FIG. 7 is a perspective view of the bag of FIG. 6; the bag is depicted as containing an ellipsoid, as discussed herein.

Shapes that are believed to be particularly well suited for use in this application are tetrahedrons, and particularly tetrahedrons that at least approximate the equilateral or "right" tetrahedron shown in FIGS. 6 and 7. The tetrahedron offers an inherent three-dimensional design, with no curved seaming necessary, that can be produced entirely as the two-dimensional structure shown in FIG. 8—it behaves as a two-dimensional structure until the bag is constructed and closed. When empty and open, it can be placed in a substantially flat configuration, without overfolding.

Although its corners may be somewhat prone to trapping of articles, this tendency is minimized due to the fact that only four corners are potentially involved. When these four corners become "crushed," the resulting shape is relatively compact. In fact, it has been observed that, following corner crushing, the walls of the tetrahedron tend to bulge, giving the resulting bag a sphere-like volume. It is conjectured that corner crushing is somewhat less likely in a tetrahedral design than in many other designs, due to the relatively acute solid angles associated with the corners and the corresponding stiffening effect of the-curved bag walls in those areas.

Figure 11:
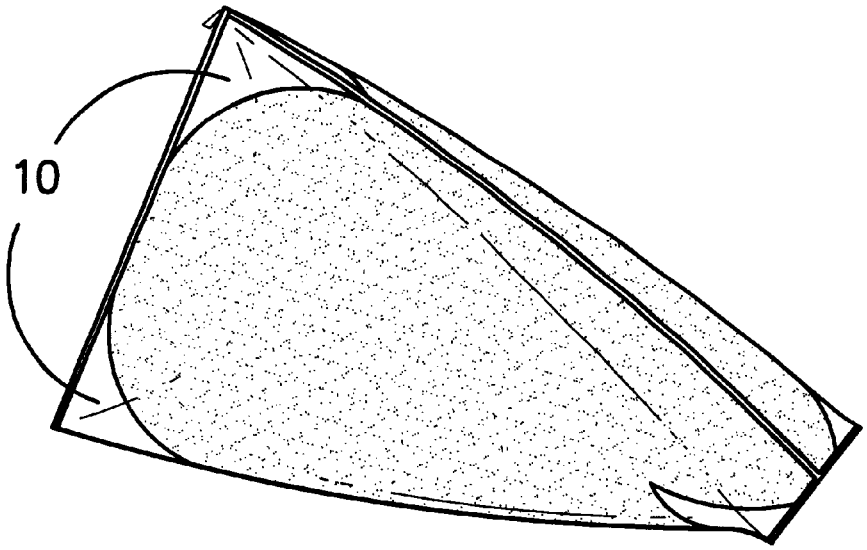
FIG. 11 is a perspective view of a bag in the shape of a tetrahedron; the exterior of the bag has been selectively coated in a pattern configuration (which, in this case, is a uniform coating that leaves the corners exposed, but the pattern configuration could be in the form of a network of stiffening ribs or the like).
Figure 12:
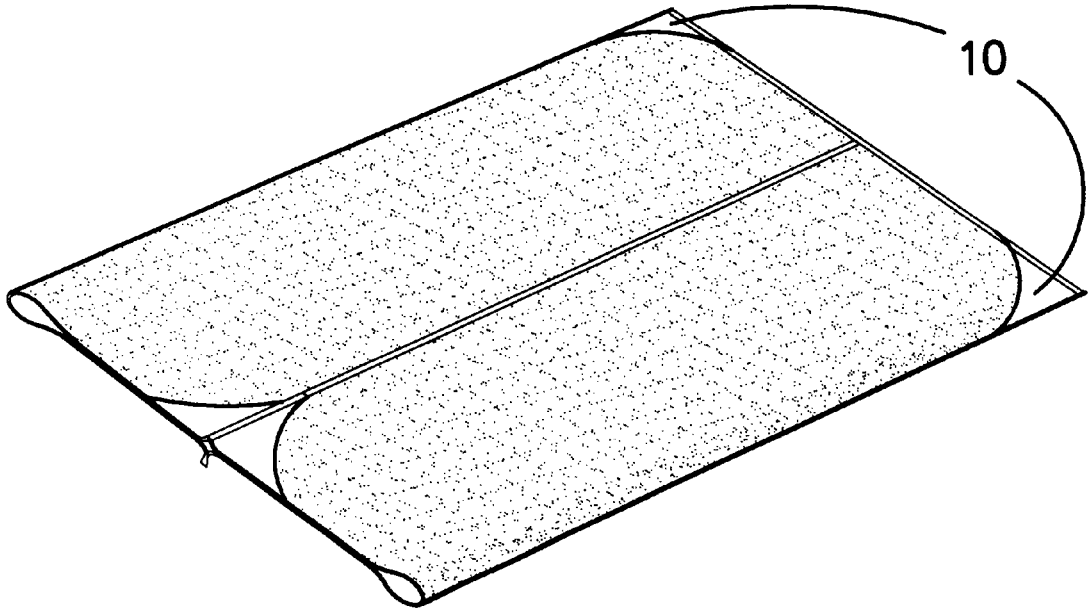
FIG. 12 is a perspective view of the bag of FIG. 11, when empty, open, and lying flat, indicating the position of the coating.

It is contemplated that corners of the tetrahedral bag can be sewn or fused along a line that serves to truncate and isolate the corner, for example, along the curved lines indicated at 10 in FIGS. 11 and 12. Although depicted as a curved line, the line can be straight or some other shape, as desired. Such corner modifications prevent articles in the bag from occupying the corner areas, and thereby decrease the occurrence of corner trapping and frequently improve bag performance.

Figure 8:
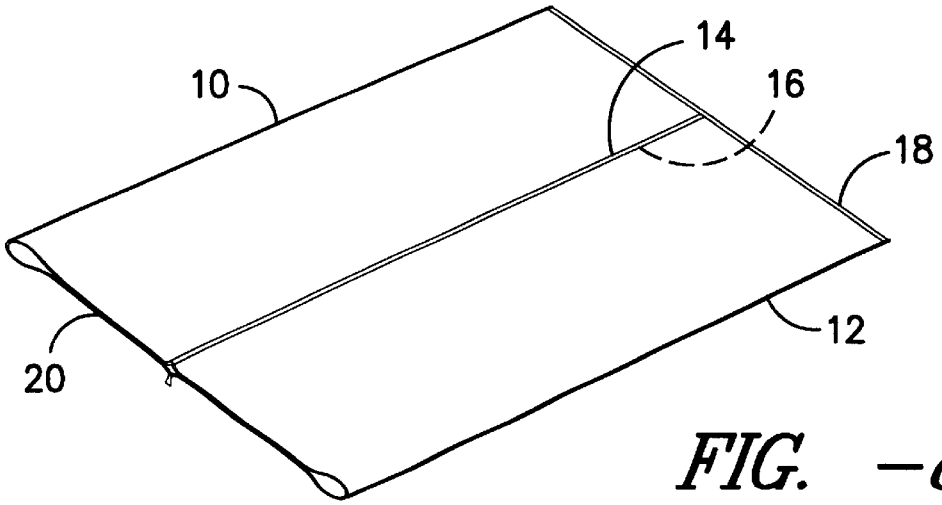
FIG. 8 is a perspective view of the bag of FIG. 6, when empty, open, and lying flat, indicating the coincident position of the end points of the zipper and the side seam, relative to the "bottom" seam of the bag (i.e., the seam opposite the zipper).

Bags derived from this design can be manufactured easily and inexpensively, using templates similar to those used to assemble a conventional two-dimensional bag, in accordance with the design indicated in FIG. 8. Two square or rectangular sections of suitable web material are each folded along a mid-line and the edges opposite the folds 10, 12 are joined together, thereby forming a flattened open cylinder with two opposing and coincident side seams 14, 16 extending the length of the cylinder. One open end of the flattened cylinder is seamed to form a closed bottom, but this bottom seam 18 does not extend from side seam to side seam. Instead, the side seams intersect the bottom seam at or near its mid-point (or at least in a substantially central region along the length of bottom seam 18), as indicated in FIG. 8.

Into the opposite open end of the flattened cylinder is installed a closure device, preferably a zipper 20, that, when engaged, forms a closed top to the cylinder. The zipper is oriented from side seam to side seam, so that, when engaged, the principal axis of the zipper forms an angle that is preferably about 90° with respect to the principal axis of the bottom seam, i.e., a projection of the zipper and the bottom seam form an "end-to-end" angle θ that is about 90°, thereby forming a "right" tetrahedron. Such a bag presents a foldable flat rectangular or square bag when the closure is open, as shown in FIG. 8, yet readily assumes the tetrahedral shape of FIG. 7 when the closure device (e.g., zipper 20) is engaged. This configuration, if constructed using panel material and seams of appropriate stiffness, not only has a very strong bias towards assuming an open, self-supporting tetrahedral configuration but also permits, for the above-mentioned geometric reasons, flat folding for packaging or storing after opening of the closure.

It is contemplated that "skewed" tetrahedrons also can be constructed for use as non-immersion dry cleaning bags; such bags can be characterized as having "end-to-end" angles of less than 90°0. A "skewed" tetrahedron is depicted in FIG. 9; the same tetrahedron, when empty and with the closure device (e.g., a zipper) disengaged, is shown in FIG. 10. In this case, the side seams 14, 16 are no longer coincident, but instead are offset—the greater the offset, the smaller the "end-to end" angle θ becomes. As the "end-to-end" angle θ is reduced from 90°, the internal volume of the resulting three-dimensional bag becomes more constricted until, when the angle approaches 0°, the bag approaches a flat, inherently two-dimensional bag. It is contemplated that "end-to-end" angles of 30°, 60°, or more may be used with success, although larger angles, and especially angles of or approaching 90°, are preferable.

In use, the tetrahedral design is relatively resistant to crimping and creasing, particularly of the kind in which the entire bag folds along a "waistline" or major crease and becomes compartmentalized, as commonly occurs with the rectangular flat bags of the prior art. In the tetrahedral design as disclosed herein, folding along any such major crease would involve the buckling of at least three stiffened and non-parallel surfaces, which makes such buckling, and the attendant trapping and tumbling problems, relatively unlikely.

This is distinctly superior to the performance of rectangular bags, and particularly the two-dimensional bags of the prior art. Such bags can become oriented in the dryer such that the plane of the bag is parallel to the axis of drum rotation. As discussed above, when this occurs, the large, substantially parallel surfaces comprising the bag walls bags tend to buckle, fold and compartmentalize, and cleaning effectiveness is adversely affected. An advantage of the tetrahedral bag is that its four corners are not coplanar, but are instead paired in planes that are at right angles to each other, or at least are substantially non-coplanar. This tends to minimize the folding and buckling induced by the rotational motion of the dryer drum, because, at any given time, the forces generated by the rotational motion of the dryer drum are not directed normal to a substantially flat surface, as depicted in FIG. 13.

The Importance of Bag Wall Construction

Although we believe a bag having an inherently three-dimensional shape is preferred, with a tetrahedral shape being particularly desirable from a manufacturing standpoint, shape is neither necessary nor sufficient to assure high performance in the non-immersion dry cleaning process discussed herein. Because bag wall buckling tends to reduce the free tumbling volume ("FTV") in a bag, and because stiff bag walls tend to prevent wall buckling, the relative stiffness of the bag wall and its various support elements—over and above what might be necessary to achieve an inherently self-supporting bag—has been found to be important in maintaining a good FTV when such bags are in use. Furthermore, it has been found that excessive friction between the articles in the bag and the interior side of the bag wall can create conditions that encourage buckling. Accordingly, the relative slickness interior surface of the bag wall is believed to be important in preventing buckling, for reasons discussed below.

It has been found that the engineered characteristics of the sheet material used to form the bag walls or panels, and the associated support structures that are associated therewith, can augment or degrade the performance of a given bag configuration. In particular, we have found that the bag configurations discussed herein that yield the best performance do so only if constructed of a sheet material that is engineered to perform as part of that configuration—certain combinations of wall stiffness and slickness characteristics make a given bag configuration perform best. We have found certain wall characteristics that appear to offer truly superior performance when used in some inherently three-dimensional bag configurations. Furthermore, we have found that wall materials yielding specific combinations of wall stiffness and interior wall slickness, sometimes engineered to fall within a relatively narrow range, can be used to improve significantly the cleaning performance of bag configurations that otherwise deliver mediocre or poor performance, including some of the inherently two dimensional bag configurations of the prior art.

Specifically, we have reached the following general conclusions concerning preferred bags and bag wall characteristics. Note that the Kawabata values discussed herein and used as measures of wall stiffness and slickness are further defined and explained below.

1. Bags that have an inherently three-dimensional shape are generally preferred over bags that are inherently two dimensional, because such three-dimensional bags tend to be better at establishing and maintaining a desirable interior shape in which the articles to be cleaned can tumble freely. This is particularly true where the mass of articles in the bag is insufficient to billow the two-dimensional design through the transfer of tumbling-induced kinetic energy to the bag wall. As discussed above, preferred shapes for the interior of a bag are those that can enclose relatively "compact" ellipsoids—those that approximate, to some degree, the shape of a sphere, at least when in use (e.g., following corner "crushing"). A particularly preferred bag shape is that of the tetrahedron.

2. For inherently two-dimensional bags, preferred wall stiffness is dependent upon the dimensions of the bag, the mass of articles being cleaned, and other factors. For such bags, care must be taken that the walls retain their kinetic resilience, i.e., the ability to move outwardly in response to the impacts of articles against the inside of the bag as a result of the tumbling action imparted by the dryer, and to recover from inward-directed impacts from dryer fins or the like. Preferred stiffness values for inherently two-dimensional bags have been found to be limited to values that are low enough to allow the bag to exhibit kinetic resilience and high enough to prevent undesirable buckling.

Generally, average Kawabata stiffness values (i.e., Bending Stiffness or "B" values) for sheet materials used to construct inherently two-dimensional bags in accordance with the teachings herein will fall within a range having a lower limit of at least about 0.6 gms (force) $cm^2/cm$, preferably about 0.7 gms (force) $cm^2/cm$, more preferably about 0.8 gms (force) $cm^2/cm$, and most preferably about 0.9 gms (force) $cm^2/cm$. Range upper limit values for average Kawabata Bending Stiffness for inherently two dimensional bags will be no more than about 3.0 gms (force) $cm^2/cm$, preferably about 2.0 gms (force) $cm^2/cm$, more preferably about 1.6 gms (force) $cm^2/cm$, and most preferably about 1.3 gms (force) $cm^2/cm$. These values presume appropriate average Kawabata coefficient of friction ("MIU") values for the interior surface of the bag. It is contemplated that, for stiffness values of about 0.6 gms (force) $cm^2/cm$ or higher, average Kawabata coefficient of friction values should be less than about 0.35, and preferably about 0.30 or less, and more preferably about 0.25 or less, and most preferably about 0.2 or less. For stiffness values less than about 0.6 gms (force) $cm^2/cm$, average Kawabata coefficient of friction values should be less than about 0.25, and preferably less than about 0.2. These values assume typical bag sizes (i.e., interior volumes of about 10,000 to about 80,000 $cm^3$, and preferably volumes within the range of about 50,000 to about 70,000 $cm^3$) and typical cleaning loads (load masses of from about 20 to about 1600 gms, and preferably load masses within the range of about 40 to about 800 gms) likely to be encountered in a home environment, and may require some adjustment for bag sizes and cleaning loads substantially outside these ranges.

3. Inherently three-dimensional bags that are relatively rigid and maintain their interior shape during use perform better than otherwise similar inherently three-dimensional bags that have insufficient rigidity and do not maintain their interior shape during use. These better-performing designs tend to be those that are self-supporting, although this condition is not necessarily sufficient to assure good performance. In general, for inherently three-dimensional bags, increased stiffness tends to result in increased performance, so long as the increased stiffness does not impair kinetic pumping and the bag remains capable of billowing.

Average Kawabata stiffness values for sheet material used to construct inherently three-dimensional bags in accordance with the teachings herein will fall within a range having a lower limit of about 0.6 gms (force) $cm^2/cm$, preferably about 1.0 gms (force) $cm^2/cm$, more preferably about 1.2 gms (force) $cm^2/cm$, and most preferably about 1.4 gms (force) $cm^2/cm$. Sheet materials with these values, and particularly the higher values, can be used to produce bags that are inherently self-supporting when closed and empty; such bags tend to remain three-dimensional in use, and generally are associated with good cleaning performance. Values defining the upper limit of the preferred range are practically limited by the desired flexibility characteristics of the bag for storage, handling, and durability purposes. Although Kawabata stiffness values within the range of about 1.5 gms (force) $cm^2/cm$ to about 2.5 gms (force) $cm^2/cm$ would be quite serviceable, maximum values outside that range, including values of 5 to 50 gms (force) $cm^2/cm$ or more, may be useful, so long as lack of kinetic resilience or coating durability does not become an issue.

For the textile composites disclosed herein, average Kawabata Bending Stiffness ("B") values appreciably less than about 0.6 gms (force) $cm^2/cm$ are believed to be potentially useful only if wall slickness is appropriately high, indicating average Kawabata coefficient of friction ("MIU") values that are suitably low and no problems with bag wall buckling occur. For best results, we believe MIU values should be less than about 0.2.

4. Inherently two-dimensional "flat" bags tend to be configured with two large, parallel, substantially coplanar panels that are attached edge-wise. As discussed above, when tumbled in a dryer, such bags often become oriented in the dryer in a position in which the rotational motion of the dryer drum, and impacts from protrusions in the dryer drum, impart a buckling force to the panels in a direction in which the panels are vulnerable to buckling, i.e., in the direction perpendicular to the plane of the panels. The inherent stiffness of the panels is frequently not effective to prevent such buckling. In such cases, increasing bag wall stiffness can be counter-productive if the increases adversely affect the kinetic resilience of the bag and impair billowing. Bag wall stiffness always must be chosen to preserve the bag's ability to maintain a desirable free tumbling volume in use.

Inherently three-dimensional bags, when tumbled in the dryer, are believed to be more resistant to folding and buckling than inherently two-dimensional bags, due to the support provided by additional, non-coplanar panels, as well as the structural advantages conferred by certain bag designs that use inherently buckle-resistant geometry, e.g., tetrahedral bags.

5. Bags that have relatively slick interior walls are generally preferred to bags that have relatively textured or rough interior walls, because there is some experimental evidence to suggest that slick-walled bags tend to maintain their interior shape during use to a much greater degree. Textured bag walls tend to allow articles being tumbled to couple to the bag wall and to "ride up" the wall into a corner of the bag, thereby causing the corner portion of the bag to accumulate mass. This condition encourages the portion of the bag wall connecting that corner with the rest of the bag to fold and buckle due to its increased mass. When that happens, the articles in that corner portion of the bag become isolated and the interior space available for the other articles to tumble freely is reduced. It is also conjectured that, by subjecting the bag wall (and any coatings or films thereon) to excessive bending and folding stresses, this condition may also adversely affect the longevity of the bag. Accordingly, we believe coefficients of friction (Kawabata surface friction or "MIU" values) for both inherently two-dimensional and inherently three-dimensional bags shall fall within the range of about 0.1 or less to about 0.45, with MIU values of less than about 0.35 being particularly useful under most conditions, assuming that a "scrubbing"-type interior is not desired (see below). Generally, Kawabata surface friction values of less than about 0.3 are preferred, and values less than about 0.25 are even more preferred. Values less than about 0.2 are, in most cases, most preferred.

6. While, in general, both wall stiffness and interior slickness are desired and preferred, there is a relationship between desired bag wall slickness and necessary bag wall stiffness. Sufficient bag wall stiffness can compensate, at least partially, for deficiencies in bag wall slickness to the extent those deficiencies encourage the bag to buckle, a situation likely to arise when, for example, articles become trapped in a corner. Therefore, if a textured bag wall interior is desired (perhaps to add a "scrubbing" action to the cleaning process), it is possible that an appropriate increase in bag wall rigidity can be used to counteract the increased tendency for wall buckling. As always, care must be taken, particularly with inherently two dimensional designs, to preserve the kinetic resilience of the bag wall.

Interestingly, the converse is not true: even an extremely slick interior surface is not likely to overcome the effects of an insufficiently stiff bag wall, even if the bag is of an inherently three-dimensional design with a "built-in" free tumbling space. In such cases, bag interior shape is likely to become undesirably distorted in use and cleaning effectiveness will be adversely affected. Furthermore, it is conjectured that excessively slick interior walls could impede proper tumbling of articles in the bag by encouraging the articles to slide around on the inside surface and restricting their ability to "ride up" a side sufficiently far to be launched into a tumbling mode. These conclusions regarding slickness apply both to inherently two-dimensional and to inherently three-dimensional designs.

Bags Using Rigidifying Wall Discontinuities

As an alternative or enhancement to the use of stiffened sheet materials to achieve the desired degree of buckling resistance, bags having seams that are inherently stiff, as occurs when two opposing layers of fabric are attached to one another, or when two or more layers of fabric or other sheet material that form the bag wall are joined along an edge, can be used to provide a stiffening influence that tends to maintain the inherent shape of the bag during the cleaning process. It is contemplated that this desirable level of stiffness can be achieved through designing the appropriate overlapped portions of panel material comprising the seam, or by integrating into the seam a permanently installed flexible stiffening member such as a rod or rib that becomes a permanent part of the seam.

If the inherent shape is two-dimensional, it has been found that bag performance is frequently adversely affected by the inclusion of stiffening seams. The inherent two-dimensional shape is not well suited to maintaining a satisfactory free tumbling volume, because the additional stiffening can impair the kinetic resilience of the bag wall and prevent proper billowing action. Accordingly, the inclusion of stiffening seams or the like generally is more effective when used with inherently three-dimensional bag shapes. Zippers or other closure means that are sewn into or otherwise made part of the bag wall also can also provide a stiffening influence to the bag wall as a result of both the closure having inherent stiffness and due to the rigidifying nature of the way in which the closure is attached to the bag wall (e.g., by sewing, bonding, etc.). Such seams, closures, and other discrete stiffening elements that have a rigidifying influence and that are incorporated into, or are a permanent feature of, the bag wall (e.g., a permanent "rib" comprising one or more beads of adhesive or the like, applied to the bag wall as a linear reinforcement), collectively shall be referred to as rigidifying wall discontinuities.

These rigidifying wall discontinuities serve as a kind of skeleton that can support and reinforce the bag walls, and can help define the three dimensional structure needed to form and maintain a free tumbling volume. While one embodiment of such skeleton would involve the seams by which the individual bag wall panels are attached to one another, the skeleton can be comprised of seams not associated with an edge of the panel material. Furthermore, the skeleton does not necessarily have to be a connected network, but rather can be comprised of a number of disconnected or non-interconnected individual elements strategically placed on or in the bag wall. The use of such skeleton has been found to be particularly effective when used in conjunction with fabrics or other suitable panel material that also exhibit some degree of stiffness. In such cases, the fabrics separating the stiffening members can serve to maintain a desirable separation between adjacent skeleton members. Because these stiffening members are an integrated part of the bag wall, and do not rely upon rods, ribs, or other separate structures that may be installed or removed, as desired, by the user, they will be referred to an integral stiffening members.

Bag Wall Constructions

It has been found that certain textile fabric constructions are well suited to constructing the preferred bag configurations disclosed herein. Many web constructions, for example, woven textile constructions, can provide the desired strength, heat resistance, and an exterior surface texture having consumer appeal to the bag, but frequently lack desirable air and moisture permeability, stiffness, and interior surface slickness. On the other hand, a polymer film or coating of the proper kind (the selection of which depends upon several factors, including the initial configuration of the bag) can provide controlled air and moisture permeability, as well as stiffness, but generally lack the durability and appeal of a woven fabric. We have found that synergistic combinations of both elements, in which the fabric and coating or film work together to form composites that are desirably stiff and slick, are particularly effective in satisfying these diverse requirements. For example, it has been found that such combinations frequently provide unexpected durability enhancement. Additionally, the woven substrate helps to distribute bag wall stresses over a larger area, thereby avoiding the concentration of stresses, for example, due to crease formation during use or storage, that can lead film-type substrates to develop small cracks or holes.

Preferably, the bag wall—comprised of the selected composite and any other structural features of the bag, to be discussed below—must not only be desirably slick on the inside, but should also have a controlled degree of stiffness to resist buckling and folding, and the attendant trapping, yet provide sufficient kinetic resilience to assure proper billowing. Although the issue of kinetic resilience applies to all bags, it is believed to be even more relevant in bags having inherently two-dimensional configurations, because inherently three-dimensional bag configurations have the advantage of geometry in maintaining an effective tumbling volume. Furthermore, it is believed that bag wall stiffness plays an important role in the venting of relatively spent cleaning vapors from the bag and the replenishment of relatively clean, dry air from the dryer interior. Such venting is believed to be driven by the kinetic pumping action derived from the motion of the articles in the bag being tumbled. That motion not only serves to displace directly the air within the bag, thereby generating air currents within the bag, but also generates collisions between the articles and the bag interior walls that cause the bag wall to undergo a kind of diaphragmatic pumping action that serves to expel spent vapors and take in relatively fresh air from the interior of the dryer.

Other parameters of importance in selecting the bag wall material are durability and heat resistance. The wall panels also need to be able to maintain an appropriate degree of stiffness throughout the desired life span of the bag (at least several cleaning cycles, and preferably tens of cleaning cycles), and need to withstand the normal range of temperatures to be expected within a residential or commercial dryer, even if the dryer is malfunctioning (i.e., temperatures up to about 340° F.).

In light of the above, we have concluded that a superior sheet material from which to construct the bags disclosed herein is a textile fabric as described herein, and preferably a textile fabric that has been coated (which is intended to include fabrics to which a film has been bonded or laminated), in accordance with the teachings herein.

The Fabric

Bags may be fabricated using a wide variety of textile materials and constructions. Textiles materials may be comprised of woven, knit, or non-woven webs. Knit fabrics may be used, but their suitability is dependent upon their construction and dimensional stability. For example, it is contemplated that warp knitted fabrics, and preferably weft insertion fabrics, could be successfully used. It is further contemplated that a heat-resistant non-woven substrate may be used, for example, one comprised of yarns having lengths within the range of about 0.5 to about 4.5 inches. Among woven fabrics, a wide variety of choices is available. Examples of plain weave fabrics that can be used include: (1) a fabric made from 150 denier texturized polyester multi-filament yarn having 30 picks per inch and 110 ends per inch; a fabric made from 150 denier texturized polyester multi-filament yarn having 78 picks per inch and 42 ends per inch; a fabric made from 70 denier texturized polyester multi-filament yarn having 25 picks per inch and 135 ends per inch; a fabric made from 70 denier texturized polyester multi-filament yarn having 98 picks per inch and 34 ends per inch. Combinations lying within these ranges of deniers, pick counts and end counts, to the extent they can be woven, would be expected to be suitable and perhaps preferred. Other constructions, for example, 2×1 woven constructions, as well as twills, satins, or combinations thereof, also may be suitable. It is contemplated that any weave construction may be used that (1) will be economic manufacture, (2) that will provide an effective substrate for the application of the desired coatings on films, (3) that will exhibit flexibility and stiffness characteristics sufficient for folding and for use with the desired bag design (e.g., the stiffness of a fabric for use in an inherently two-dimensional bag can exceed the range within which such bags perform well), and (4) that will not exhibit undesirable characteristics with respect to hand, flammability, durability, heat resistance, etc.

It is also contemplated that yarn deniers outside this range, for example, deniers having a lower limit of about 30, and preferably about 50, and most preferably about 70, and having an upper limit of about 600, and preferably 400, and most preferably about 200, may be used. The yarns may be comprised of nylon, cotton, polyester, polypropylene (if expected thermal conditions permit) acrylic, or modacrylic fibers, or appropriate blends thereof. They may include filament yarns, spun yarns, and core spun yarns, or may include the slit film-type yarns associated with woven slit film constructions. It should be kept in mind that all such yarns and fabric constructions should exhibit physical characteristics that are appropriate for this use, such as heat resistance and abrasion resistance, and should meet requirements regarding flammability, dyeability, etc.

Films and Coatings

Thermoplastic or thermosetting polymeric films or coatings may be applied to or on the above textile substrates for the purpose of imparting desired stiffness and interior smoothness, as well as controlling the "through-the-bag-wall" air and vapor permeability, of the resulting bag. As used herein, the term "facing" shall refer to either coatings or films—including tie layers or the like—that have been applied to and that form a part of a substrate surface. Any polymer film or polymer formulation that can be readily applied to textile substrates by either lamination or by any of the conventional textile coating methods may be used, so long as the resulting surface exhibits the following characteristics, where appropriate:

1. Adequate heat resistance.
2. Appropriate degree of stiffness at room temperature and at tumble drying temperature.
3. Satisfactory durability.
4. Satisfactory toughness.

Additionally, it is preferred that the polymeric facing formulation also exhibit the following characteristics:

5. Capability of forming a continuous polymer layer.
6. Capability, at the instant of application, to flow onto and penetrate the interstices of the substrate (including both inter-yarn and intra-yarn interstices) to ensure good adhesion, preferably by, for example, fiber or yarn encapsulation or spreading into the yarns or fiber bundles so as to anchor such coatings.

Examples of available thermoplastic polymer systems useful and effective for such coatings are polyester, and in particular polybutylene terephthalate, such as Hytrel® by DuPont (Wilmington, Del.) or Riteflex® by Ticona (Summit, N.J.), nylon, and various polyolefin systems, for example, polypropylene homopolymer, as well as nucleated or filled polymer systems. Reactive polyamides such as the Ultramids from BASF (Wyandotte, Mich.) are also viable thermoplastic candidates. Depending upon the heat resistance required, thermoplastic polyolefine such as, for example, polypropylene, are available from Huntsmann Chemical Company (Salt Lake City, Utah). Examples of thermosetting polymers are crosslinkable acrylic dispersions such as Rhoplex from Rohm and Haas (Philadelphia, Pa.) and the "Hycar" line from B. F. Goodrich (Cleveland, Ohio). Thermosetting silicones such as those from Dow Corning (Midland, Mich.) are another good example of viable polymers that could be used.

Polymer Application to Textile Substrate

The polymer facing can be applied to a textile substrate as a film or a liquid coating by any appropriate conventional means. Suitable methods for application may be selected from the group consisting of coating, laminating, and extruding. A preferred method applies the polymer facing to the textile substrate by extrusion coating, in which the polymer is extruded in the form of a molten curtain that is applied to the substrate, followed by the application of pressure (as from a roll) to force the cooling but still-fluid polymer into the structure of the substrate. Alternative methods of application of the facing to the substrate include those known in the art, e.g., application of a suitable coating composition using a knife, transfer roll, spray, powder coater, etc., as well as application of a pre-formed film using an appropriate lamination process. To generate the polymer facing component of the substrate comprising the bag wall, coating composition add-on values having a lower add-on limit of about 0.5 oz./yd.$^2$, and preferably about 0.8 oz./yd.$^2$, and more preferably about 1.3 oz./yd.$^2$, and most preferably about 1.6 oz./yd.$^2$, and an upper add-on limit of about 6 oz./yd.$^2$, and preferably about 4 oz./yd.$^2$, and more preferably about 3 oz./yd.$^2$, and most preferably about 2.6 oz./yd.$^2$ may be used. Using typical woven textile substrates, the resulting composite has an overall average thickness of between about 5 and about 11 mils, and preferably between about 6 and about 9 mils. Values outside these ranges may be preferred for bags used in, e.g., commercial applications, or other web constructions, e.g., knitted substrates.

Preferably, the coating process is performed in such a fashion that the resulting polymer facing is firmly attached to the fabric and essentially encapsulates many or most of the yarns, and effectively penetrates and seals at least a portion—perhaps substantially all—of the interstices between the yarns or yarn bundles and forms spot-bonds between adjacent yarns. The facing may penetrate the interstices of the yarn bundle and at least partially encapsulate the individual filaments.

The facing may also at least partially fill the interstices of the chosen textile substrate, for example, a woven fabric, to form anchoring structures on the opposite side of the woven fabric. These anchoring structures on the exterior side have their largest diameter greater than that of the interstices in the woven fabric (similar to a flattened mushroom head) so as to increase resistance to de-lamination of said woven fabric from the polymer facing. Accordingly, bags comprising fabric composites comprising such anchoring structures are highly resistant to de-lamination between the woven fabric component and the polymer facing. The use of textured yarns as compared with untextured multi-filament yarns in woven or knitted fabrics can provide fabric composites having increased resistance to de-lamination.

It is contemplated that, either to replace or supplement an extrusion coating, a facing formulation can be applied to the exterior of the bag that has a significant stiffening effect on the bag wall. Application of this optional facing can be through known coating or printing techniques. This external facing can be applied uniformly, or can be applied in the form of a pattern. FIGS. 11 and 12 show, respectively, an empty tetrahedron-shaped bag constructed in accordance with the teachings herein in closed and open form. The facing shown has been formed in a pattern configuration that omits facing of the corner areas beyond the somewhat arbitrary drawn line 10. By isolating and excluding the corner areas from this optional coating treatment, the corner areas become predisposed to crushing due to their lower stiffness, and thereby transform the interior space into the stiff, somewhat sphere-like volume that promotes free tumbling and effective cleaning. Other patterns, for example, ones comprising a series or network of connected or unconnected lines or strips of the polymer, are also contemplated.

It is also contemplated that the corner area of the tetrahedron could be constructively truncated, as, for example, by a generally diagonally-oriented straight or curved seam (or other barrier or constriction), to isolate the corner area from the enclosed space available for the free tumbling of articles, and thereby prevent articles in the bag from becoming trapped in that corner area. In the case of the tetrahedron, a preferred embodiment is to truncate all four corners in this manner, perhaps along the curved line indicated at 10 in FIGS. 11 and 12. For manufacturing efficiency, one or more straight lines may be preferred. This general approach is not limited to tetrahedral bags, but can be applied to any bag having a geometric shape that results in the formation of corners or other areas in which the bag walls are closely spaced and tend to trap articles. Truncation can also be accomplished through means other than seams, such as a series of spot-bonded areas that, through the use of adhesives or other means, effectively join opposing portions of the bag wall near a corner area in a manner that prevents articles from entering that corner area.

The Kawabata Evaluation System

Because of the important roles played by rigidity and surface slickness in the performance of these bags, a specialized, quantitative measure of these parameters—the Kawabata Evaluation System—was utilized, and shall be described below.

The Kawabata Evaluation System ("Kawabata System") was developed by Dr. Sueo Kawabata, Professor of Polymer Chemistry at Kyoto University in Japan, as a scientific means to measure, in an objective and reproducible way, the "hand" of textile fabrics. This is achieved by measuring basic mechanical properties that have been correlated with aesthetic properties relating to hand (e.g., slickness, fullness, stiffness, softness, flexibility, and crispness). The mechanical properties that have been associated with these aesthetic properties can be grouped into five basic categories for purposes of Kawabata analysis: bending properties, surface properties (friction and roughness), compression properties, shearing properties, and tensile properties. Each of these categories is comprised of a group of related mechanical properties that can be separately measured. The properties of interest here are bending properties (specifically stiffness), (for example, as a measure of the bag's ability to maintain a free tumbling volume) and surface properties (specifically friction or slickness), (for example, as a measure of the bag's ability to resist buckling due to the trapping of articles inside the bag).

The Kawabata System uses a set of four highly specialized, custom-developed measuring devices. These devices are as follows:

Kawabata Tensile and Shear Tester (KES FB1)

Kawabata Pure Bending Tester (KES FB2)

Kawabata Compression Tester (KES FB3)

Kawabata Surface Tester (KES FB4)

KES FB 1 through 3 are manufactured by the Kato Iron Works Co., Ltd., Div. of Instrumentation, Kyoto, Japan. KES FB 4 (Kawabata Surface Tester) is manufactured by the Kato Tekko Co., Ltd., Div. of Instrumentation, Kyoto, Japan. The results reported herein required only the use of KES FB 2 and FB 4.

For the testing relating to the sheet material characteristics of rigidity and slickness described herein, only Kawabata System parameters relating to the properties of bending and surface were used, as indicated in Table 1, below.

TABLE 1

KAWABATA SYSTEM PARAMETERS AND UNITS

| Kawabata Test Group | Kawabata Property and Definition | Property Units |
|---|---|---|
| Bending | Bending Modulus<br>B = Bending Rigidity per unit width | Gms (force) $cm^2/cm$ |
| Surface | MIU = Coefficient of friction (dynamic or kinetic) | Dimensionless |

The complete Kawabata Evaluation System is installed and is available for fabric evaluations at several locations throughout the world, including the following institutions in the U.S.A.:

North Carolina State University
College of Textiles
Dep't. of Textile Engineering Chemistry and Science
Centennial Campus
Raleigh, N.C. 27695

Georgia Institute of Technology
School of Textile and Fiber Engineering
Atlanta, Ga. 30332

The Philadelphia College of Textiles and Science
School of Textiles and Materials Science
Schoolhouse Lane and Henry Avenue
Philadelphia, Pa. 19144

Additional sites world-wide include The Textile Technology Center (Sainte-Hyacinthe, QC, Canada); The Swedish Institute for Fiber and Polymer Research (Mölndal, Sweden); and the University of Manchester Institute of Science and Technology (Manchester, England).

The Kawabata Evaluation System installed at the Textile Testing Laboratory at the Milliken Research Corporation, Spartanburg, S.C. was used to generate the numerical values reported herein.

Kawabata Bending Test Procedure

A 20 cm×20 cm sample was cut from the web of fabric to be tested. In the case of extremely stiff substrates, a 5 cm×10 cm sample was used. Care was taken to avoid folding, wrinkling, stressing, or otherwise handling the sample in a way that would deform the sample. The die used to cut the sample was aligned with the yarns in the fabric to improve the accuracy of the measurements. Multiple samples of each type of fabric were tested to improve the accuracy of the data. The samples were allowed to reach equilibrium with ambient room conditions prior to testing.

The testing equipment was set-up according to the instructions in the Kawabata Manual. The machine was allowed to warm-up for at least 15 minutes before samples were tested. The amplifier sensitivity was calibrated and zeroed as indicated in the Manual. The sample was mounted in the Kawabata Pure Bending Tester (KES FB2) so that the cloth showed some resistance but was not too tight. The fabric was tested in both the warp and fill directions, and the data was automatically recorded by a data acquisition program running on a personal computer. The value of "B" for each sample was calculated by a personal computer-based program that merely automated the prescribed data processing specified by Kawabata, and the results were averaged over both multiple samples and warp and fill directions, with measurements taken when the samples were flexed in opposite directions.

Kawabata Surface Test Procedure

A 20 cm×20 cm sample was cut from the web of fabric to be tested. Care was taken to avoid folding, wrinkling, stressing, or otherwise handling the sample in a way that would deform the sample. The die used to cut the sample was aligned with the yarns in the fabric to improve the accuracy of the measurements. Multiple samples of each type of fabric were tested to improve the accuracy of the data. All samples were allowed to reach equilibrium with ambient room conditions prior to testing.

The testing equipment was set-up according to the instructions in the Kawabata Manual. The Kawabata Surface Tester (KES FB4) was allowed to warm-up for at least 15 minutes before use. The proper weight (400 g) was selected for testing the samples. The samples were placed in the Tester and locked in place. The coated or film-carrying surface of each sample was tested for surface friction, and the data was recorded by a data acquisition program running on a personal computer. The value of "MIU" for each sample (a dimensionless number) was calculated by a personal computer-based program that merely automated the prescribed data processing specified by Kawabata, and the results were averaged over both multiple samples and warp and fill directions. The value of MIU measured reflects the kinetic friction between the substrate surface and a ribbed metal surface that is moved slowly across the substrate surface.

Kawabata Testing Results

FIG. 14 summarizes the results of Kawabata stiffness and surface friction testing that was performed on various sheet materials used in commercially available inherently two-dimensional home dry cleaning bags ("prior art" bags), as well as the results of certain testing performed in the course of developing the sheet materials disclosed herein. It should be noted that, because of small, unavoidable variations in the test conditions and the inability to acquire, in all cases, the same level of statistical confidence for all results, the indicated results should be considered representative of actual test values, rather than actual test values.

The average Kawabata stiffness and surface friction values for all tested prior art sheet materials are clustered in the lower central region of the chart, with typical average Kawabata stiffness values within the range of about 0.15 to about 0.6 gms (force) $cm^2/cm$ and typical average Kawabata surface friction values within the range of about 0.2 to about 0.28. The sheet materials developed in connection with the bags described herein are also clustered, but in areas distinct from the prior art sheet materials—these materials had typical average Kawabata stiffness values within the range of about 0.6 to about 2.0 gms (force) $cm^2/cm$ and typical average Kawabata surface friction values within the range of about 0.15 to about 0.35, although values outside these ranges are contemplated. It should be noted that, in general, the bags made with sheet materials having the higher stiffness values tended to perform better in inherently three-dimensional bags than bags with lower stiffness values, even where coefficients of friction were essentially similar.

Closures and Their Role in Gas Exchange

As discussed above, a key mechanism responsible for the effectiveness of non-immersion dry cleaning systems involves the purging of relatively spent cleaning gases from the bag, thereby allowing relatively fresh air to enter the bag and causing the generation of replacement cleaning gases. Without this purge/regeneration process, the cleaning vapors inside the bag would quickly become saturated with soil and spent cleaning agent, and would be unable to continue the cleaning process. The design of the bag must allow for this exchange of gases.

Bags of the prior art are provided with various vents, openings, and other means to facilitate the exchange of gases into and out of the bag when in use. These vents and openings (1) can take the form of separate openings in the bag wall, (2) can be a part of the closure means used to secure the articles within the bag, (3) can be associated with an inherent property (vapor porosity) of the bag wall itself, or can comprise a combination of these elements. For example, one exemplary bag of the prior art uses a vent associated with a closure means—specifically, a flap secured with a hook and loop system (e.g., Velcro®—type systems) that extends along most, but not all, of the length of the flap. The flap itself is associated with the opening through which the articles are placed into and withdrawn from the bag. Those portions of the flap that remain unsecured—which can be near opposite ends of the flap, or elsewhere along the length of the flap—function as an opening through which the necessary exchange of gases can take place. Similarly, unsecured areas between buttons, snaps, or other discrete fastening devices could also provide a route for gas exchange. Separate openings associated with side seams or corners may also be effective. In general, the faced substrates that are discussed herein as preferred bag wall components do not lend themselves to efficient gas transport.

As part of the novel and preferred bag constructions described herein is the use of a zipper with specific characteristics as a closure means. Although zippers are recognized in the prior art as closure devices, and various closure devices are known to be useful as venting devices as well, dry cleaning bags intentionally using zippers as venting devices are not well known. Unlike other sliding-type securing means such as bead and groove closures (e.g., Ziplok®—type fasteners), it has been discovered that zippers having specific air permeability values can be used as the sole venting means for a dry cleaning bag, even when the zipper is entirely closed.

Examples 1 through 6 are intended to further illustrate details, features and embodiments of composites used in manufacturing containment bags for use in non-immersion dry cleaning applications. It should be noted that Style Numbers are those of Milliken & Company, of Spartanburg, S.C. For Examples 1, 2, 3, and 5, the extruding equipment was manufactured by the Egan Machinery Division (Somerville, N.J.), of John Brown Plastics Machinery, (now Egan Davis Standard). This extruder was equipped with a six inch, 24:1, single flight polyolefin screw. The positioning of the die relative to the rolls and substrate is important to optimize adhesion and adhesion uniformity, and to minimize the potential for streaks, but is dependent upon the specific extruder machine used. All reported thickness measurements were performed in accordance with ASTM D-1777.

EXAMPLE 1

A polypropylene/polyethylene blend (70%/30%) from Huntsman Chemical Company of Salt Lake City, Utah (Stock No. P9H7M-026) was used to extrusion coat 70 denier woven polyester fabric. The two components melt at roughly 100° C. (polyethylene) and 155+ C. (polypropylene), and when melt-blended, the composite melts at 151° C. Immediately after the application of the molten polymer, the coated fabric was nipped at a chill roll operating at 75° F. A Teflon®—coated nip roll was used. Polymer add-on was monitored with a Eurotherm Beta gauge. The line speed for the coating was approximately of 200 ft./min.

Four different levels of coating thickness—extruded sheets of 2.0 mils, 2.25 mils, 2.5 mils, and 2.75 mils—were applied to the fabric, which corresponds to respective add-on weights of 1.4, 1.6, 1.8, and 2.0 ounces of polyolefin/yd$^2$. By varying the thickness of the coating, the final stiffness of the composite could be controlled. The 2.0 mil coating was applied to a single ply 70 denier, 34 filament polyester (DuPont Dacron®) plain weave fabric with 92 warp yarns per inch and 84 fill yarns per inch. The three higher thickness coatings were applied to a single ply 70 denier, 34 filament polyester plain weave fabric with 100 warp yarns per inch and 80 fill yarns per inch. The measured average Kawabata bending stiffness values for the resulting coated composites were 0.5, 0.7, 0.8, and 1.2 gms (force) cm$^2$/cm, respectively. The average Kawabata surface friction coefficients for these coated composites were 0.31, 0.31, 0.31, and 0.32, respectively. The respective masses of the coated composites were 3.4, 3.4, 3.7, and 3.8 ounces/square yard and their respective thicknesses were 6.1, 5.8, 6.0 and 6.3 mils. The variation in thickness shows that more polymer add-on does not make for a thicker composite, due to the varying degree of penetration of the coating into the fabric. The composites all had an initial air permeability value of no more than 0.001 ft.$^3$/min./ft$^2$, as measured with a Textest FX3300 air permeability tester machine with a test pressure of 125 Pascals. SEM and optical photomicrographs clearly show that the coating penetrates the interstices of the woven fabric from the back face of the fabric onto the front face and forms a "mushroom head." There is also some penetration of the coating into the yarn bundles. This mechanical adhesion allowed the coated fabric to withstand 50–100 half-hour dryer cycles at a "High" heat setting (about 190° F.).

To test the performance of the bags, the V.V.E. test as described in U.S. Pat. No. 5,789,368 by You, et al, the disclosure of which is hereby incorporated by reference, was performed. This test measures the amount of moisture vented from the container during a thirty minute "high heat" clothes drying cycle. A test load comprised of one silk blouse, one wool sweater, and one rayon swatch with a total mass of about 400 grams, along with an available cleaning agent intended for use in non-immersion dry cleaning applications, distributed by Procter and Gamble of Cincinnati, Ohio, was used. For purposes of these evaluations, an unfavorable cycle is defined as a cycle after which one or more of the articles in the test load, including the carrier for the cleaning agent, are excessively wet. This is considered to be an indication that the bag has undergone excessive buckling and folding, sufficient to adversely impact the tumbling of the garments in the bag. The mass of the carrier is about 5.6 grams when it is dry, and about 29 grams when initially loaded with a liquid cleaning agent. A carrier sheet with a mass over 6.5 grams at the end of a cycle was interpreted to be an unfavorable cycle.

Inherently two-dimensional, rectangular containment bags were prepared with dimensions of 660 millimeters by 680 millimeters by sewing together two congruent panels of the above-described coated substrate along three seams, after inserting a 24.5 inch long zipper (YKK model HRC31 B-2, available from YKK (U.S.A.) Inc. of Marietta, Ga.). Each bag was cycled through fifty cleaning cycles of 30 minutes in a Kenmore 70 Series residential dryer (Model #66702692), using the "High" setting or cycle. Internal temperatures were approximately 170–180° F. The percentage of unfavorable cycles for the bags prepared from the 2, 2.25, 2.5 and 2.75 mil polyolefin-coated fabrics were 17%, 4%, 6% and 2%, respectively. These data generally indicate that the use of stiffer bag wall materials produce a containment bag that cleans better and more consistently through multiple uses than bags using less stiff materials. To improve the heat resistance of the resulting composite, a coating material with improved heat resistance can be used.

EXAMPLE 2

In this Example, a thermoplastic polyester elastomer from the Riteflex® product line distributed by Ticona (Summit, N.J.) was used, having a melting point of 210° C. The Shore hardness of this polymer used in this example was 63D, although other polymers with different stiffness and toughness characteristics are available within this product line. The elastomeric properties of these specific polymers are important to provide toughness for the coating to allow it to resist stress cracking under the typical mechanical action that accompanies this dry cleaning process. The chill roll was at 120° F. A Teflon®—coated nip roll was used. A fabric pre-heater was used at 250° F. The polymer was dried for 4 hours at 225° F. before coating. Two different plain weave fabrics were coated at 200 feet/minute. The first was a single ply 70 denier, 34 filament plain weave polyester fabric (Milliken & Company Style No. 961331). This fabric had 102 warp ends per inch and 80 fill ends per inch. The second fabric used was a 150 denier plain weave polyester fabric with 66 warp ends per inch and 50 fill yarns per inch. (Milliken & Company Style No. 784721) The warp yarns had 34 and the fill yarns had 50 filaments. For both fabrics, approximately 2.2 oz./yd.$^2$ of the Riteflex 663 were added onto the fabrics.

The first composite, comprised of a coated 70 denier fabric, had an average Kawabata Bending stiffness of 0.6 gms (force) cm$^2$/cm and a surface coefficient of friction of 0.38, a mass of 4.2 ounce/square yard, and thickness of 5.5 mils. The second composite, comprised of a coated 150 denier fabric, had an average Kawabata bending stiffness of 1.1 gms (force) cm$^2$/cm, a surface friction coefficient of 0.26, a mass of 4.8 ounces/square yard, and a thickness of 7.3 mils. Both fabric composites had an initial air permeability of no more than 0.001 ft.$^3$/min./ft$^2$ as measured with a Textest FX3300 air permeability tester machine with a test pressure of 125 Pascals. This example serves to demonstrate that the choice of fabric for coating can also affect the stiffness with the same polymer add-on.

An additional method by which the composite can be stiffened is to treat the fabric with a hand builder. Samples were prepared of the 70 and 150 denier fabrics by padding on a chemical adhesive promoter comprising an aqueous solution of 5% Witcobond W-290H, from Witco Corporation (Melrose Park, Ill.), and 5% Epirez 5520 from Shell Chemical (Houston, Tex.) at a 75% wet pickup level prior to coating. The fabrics were then coated as before. The 70 denier fabric composite with a hand builder had an average Kawabata bending stiffness of 0.8 gms (force) $cm^2/cm$, a surface friction value of 0.33, a mass of 4.1 ounces/square yard, and a thickness of 5.6 mils. The 150 denier fabric composite with a hand builder had an average Kawabata bending stiffness of 1.3 gms (force) $cm^2/cm$, a surface friction value of 0.29, a mass of 4.8 ounces/square yard, and a thickness of 7.2 mils. Post-coating microscopic evaluation of all of the above fabrics indicated that they all possessed the "mushroom caps" described in Example 1.

All four of the fabrics of Example 1 were formed into tetrahedral bags in the following manner. Two congruent panels 660 mm by 680 mm were cut. Each was folded in half along the 680 mm direction, resulting in two 680 mm×330 mm constructions having a fold along one side and two open edges along the remaining three sides. The two folded panels were arranged with the fold in the outboard position and the open edges directly opposite and contiguous to each other. The opposing top and bottom edges were then joined by two parallel, coincident seams, thereby forming a flattened, open-ended cylinder having two seams extending along the length of the cylinder, on opposing sides of the cylinder. One of the open ends of the flattened cylinder was sealed with a "bottom" seam. A disengaged 24.5 inch zipper (YYK Style No. HRC31B-2) was sewn into the opposite end of the cylinder, with the ends of the zipper being aligned with the side seams. When the zipper was engaged, the axis of the zipper (along the "top" of the bag) was approximately 90° from the axis of the "bottom" seam, and the bag assumed a three-dimensional, tetrahedral shape.

Each bag was then subjected to up to 60 cleaning cycles as described in Example 1, and the percentage of unfavorable cycles was noted. For the 70 denier Riteflex 663 coated fabric bag, 55% of the cycles were considered unfavorable. For the coated 70 denier fabric with a hand builder, 38% of the cycles were considered unfavorable. For the 150 denier coated fabric, 33% of the cycles were considered unfavorable. For the coated 150 denier fabric with a hand builder, 15% of the cycles were considered unfavorable.

This example indicates that for the inherently three-dimensional bag, the performance of the bag clearly improved with increased stiffness of the composite fabric. To further improve the stiffness of the fabric, more polymer could be added onto the fabric, a stiffer initial fabric could be chosen, or an initially stiffer polymer could be added onto the fabric as will be detailed in the following example.

EXAMPLE 3

In this Example, a thermoplastic polyester elastomer from the Hytrel® product line distributed by DuPont (Wilmington, Del.) was used, having a melting point of 212° C. The Shore hardness of this polymer was 72D, although other polymers with different stiffness and toughness characteristics are available. The stiffness of this polymer is therefore intrinsically higher than that of the Riteflex® 663 of Example 2. The elastomeric properties of this type of polymer is important to provide toughness for the coating to allow it to resist stress cracking under the typical mechanical abrasion present in the dryer cleaning process.

For this example, three fabrics were coated. The first fabric was the single ply 70 denier, 34 filament plain weave fabric (Milliken & Company Style Number 961331) of Example 2. The second fabric was the 150 denier plain weave fabric (Milliken & Company Style Number 784721) of Example 2. The third fabric was a 150 denier plain weave fabric with a construction of 66 warp yarns per inch and 60 fill yarns per inch (Milliken & Company Style Number 925512). The first coating run used a rubber nip with Shore hardness of 85D and a fabric preheater set to 175° F. The chill roll was set at 60 degrees Fahrenheit, with 2.2 oz./yd.$^2$ of polymer add-on. The coating speed was 200 ft./min. The measured average Kawabata bending stiffness values for each of the Style Nos. 961331, 784721, and 925512 were 0.9, 1.5 and 1.9 gms (force) $cm^2/cm$, respectively, with a mass of 3.9, 4.6, and 5.1 oz./yd.$^2$, respectively. The respective Kawabata surface friction coefficients were 0.21, 0.16, and 0.18, and the measured thickness of the resulting composite was 10.6, 11.3 and 8.4 mils, respectively. To allow for convenient referral to these results, the composites from this first coating run shall be designated 1-1 (Style No. 961331), 1-2 (Style No. 784721), and 1-3 (Style No. 925512).

For a second coating run, everything was the same as above except that a teflon coated nip roll with shore hardness of >95D, a preheater temperature of 250° F., and a chill roll temperature of 175° F. were used. The coating thickness remained set for an add-on of 2.2 oz./yd.$^2$ of coating. The measured average Kawabata bending stiffness values for the coated Style Nos. 961331, 784721, and 925512 were 0.7, 1.2 and 1.3 gms (force) $cm^2/cm$, respectively, with respective masses of 3.8, 4.7, and 5.1 oz./yd.$^2$. The surface friction coefficients for the respective Styles were 0.25, 0.19, and 0.23, and the respective measured thicknesses of the composite were 6.5, 7.7 and 8.3 mils. To allow for convenient referral to these results, the composites from this second coating run shall be designated 2-1 (Style No. 961331), 2-2 (Style No. 784721), and 2-3 (Style No. 925512).

For a third coating run, only the Style No. 784721 fabric was run. The extruder operating conditions were as follows: Teflon® nip roll, chill roll temperature of 90° F., fabric pre-heat temperature of 250° F. Polymer add-on was 2.2 oz./yd.$^2$. The resulting average Kawabata bending stiffness was 1.4 gms (force) $cm^2/cm$, with a mass of 4.8 oz./yd.$^2$, a surface friction coefficient of 0.26, and a thickness of 7.5 mils. To allow for convenient referral to these results, the composite from this third coating run shall be designated 3-2.

All of the above coated composites in each of these coating runs had an initial air permeability of not more than 0.001 $ft.^3/min./ft^2$ as measured with a Textest FX3300 air permeability tester machine with a test pressure of 125 Pascals. Bags made from these fabrics were run for up to 60 cycles, as described in Example 1, and the wall material did not delaminate, thereby demonstrating superior potential longevity. Comparing Samples 1-2, 2-2, and 3-2 shows that the amount of penetration of the polymer coating into the fabric substrate affects the final composite properties. Comparing these fabric composites with the composite of Example 2, the samples have roughly the same composite mass but have a higher bending stiffness. This shows that increasing the intrinsic stiffness of the polymer coating, with all else remaining the same, can increase the bending stiffness of the composite.

To test the dependence of performance for inherently two-dimensional ("flat") bags made from these fabrics with different composite bending stiffness, bags as described in Example 1 were prepared from the substrates 1-1, 2-1, 2-2, and 2-3. These four fabric composites were chosen because they span a broad range of average Kawabata bending stiffness. The percentage of unfavorable cycles were measured as described in Example 1, using a 400 gm test load. For sample 2-1, 11.5% were unfavorable; for sample 1-1, none were unfavorable; for sample 2-2, 14.8% were unfavorable; and for sample 2-3, 19.7% were unfavorable. This behavior indicates that there is an "optimum" stiffness value for an inherently two-dimensional bag, and that stiffness value for a 400 g test load is most probably within the range of about 0.7 and about 1.1 gms (force) $cm^2/cm$. If the wall stiffness is significantly less than the "optimum" value, the bag is likely to fail to maintain its billowed state and will collapse. If the wall stiffness is significantly above the "optimum" value, the walls are likely to lack the kinetic resilience to maintain the internal volume necessary for the cleaning process to be effective. This optimum stiffness will likely depend on the mass of the garments in the bag, as well as other factors (e.g., wall slickness).

To test the dependence of the performance of shaped bags made from these fabrics, tetrahedral bags as described in Example 2 were fabricated from Samples 2-2 and 3-2, and the percentage of unfavorable cycles, as described in Example 1, were measured. For Sample 3-2, 38% were unfavorable; for Sample 2-2, none were unfavorable. This trend again suggests that stiffer is better for the fabric composite wall panels when making inherently three-dimensional, shaped bags such as the tetrahedron-shaped bag.

EXAMPLE 4

In this Example, nylon 6 films laminated to polyester woven fabrics were again examined. A heated transfer press operating at 375° F. and a pressure from 60–80 PSI, with residence times of 10–30 seconds, was used to laminate the nylon 6 films to woven fabric using an adhesive web from Spunfab, V16010. Composites using a 70 denier, 34 filament plain weave fabric with 100 warp ends and 80 fill ends were constructed, using a 1 and 2 mil nylon 6 film ("Capran") from Allied Signal (Pottsville, Pa.). The melting points of the components were as follows: polyester yarns: 252° C.; nylon 6: 217° C.; the adhesive web: 98° C. The resulting average Kawabata Stiffness values were 0.6, and 1.3 gms (force) $cm^2/cm$ for the 1 mil, and 2 mil nylon 6 laminated composites. The average Kawabata surface coefficients of surface friction for the samples (at 75% Rel. Hum.) were 0.15, and 0.14 at 73° F. respectively. The sample masses were 3.6, and 4.4 ounces/square yard, with thicknesses of 7.4, and 8.7 mils, respectively. When these fabrics were placed in the dryer for 1 hour and removed, then measured immediately, their average Kawabata bending stiffnesses had changed to 0.8, and 1.7 gms (force) $cm^2/cm$, respectively. Their coefficients of friction had changed to 0.16, and 0.18, respectively. Each of the nylon composites had lost mass (from 1–4%) as well during the hour in the dryer. This change in properties is due to the loss of water from the nylon. The water serves to plasticize the nylon; when the water is driven off, as would occur in a dryer while the bag is in use, the nylon stiffens, thereby stiffening the bag. After leaving the composites for approximately one hour to allow the fibers to equilibrate, the stiffness properties returned nearly to their starting points. The fabric backing for the nylon film extends the life of the nylon film to more than 50 cycles. The nylon laminate bags of the prior art that we examined tended to show holes in the film after about 20 or 30 cleaning cycles.

When used to construct an inherently two-dimensional bag as in Example 1 and used in cleaning cycles, the 1 mil nylon 6 composite performed much better than expected, given an initial average Kawabata stiffness of 0.6 gms (force) $cm^2/cm$. The percentage of unfavorable cycles was measured as described in Example 1. Only 3.8% of the cycles were unfavorable, compared with 11.5% unfavorable cycles for Sample 2-1 in Example 3 and 17% unfavorable cycles for the 2 mil polyolefin coated sample in Example 1.

This result is believed to be due to the stiffening of the bag substrate during the dryer cycle. The average Kawabata stiffness measured following a single dryer cycle (similar to the cycles of Example 1) was 0.8 gms (force) $cm^2/cm$, close to the value measured for Sample 1-1 of Example 3, the composite of the bag having no unfavorable cycles. The 2 mil nylon 6 laminate does not perform well in a flat bag configuration: 29% of the cycles were unfavorable for a flat bag prepared as in Example 1 for this laminated composite. This is a higher number of failures than for a flat bag manufactured from sample 2-3 of Example 3 (19.7%) that had nearly the same average Kawabata bending stiffness of 1.3 gms (force) $cm^2/cm$. This higher number of unfavorable cycles is believed to be due to stiffening of the composite in use, thereby restricting the bag's kinetic resilience and making it more difficult for the bag to open to provide a sufficient free volume. This 2 mil laminate is believed to be more suited to an inherently three-dimensional bag.

EXAMPLE 5

The Riteflex 663-coated 150 denier plain weave fabric from Example 2 was used as a substrate to prepare the flat bags of Example 1 and tetrahedral bags of Example 2. This Example compares the ability of the inherently flat bags with the inherently shaped bags to protect light, delicate garment loads such as a single, 60 gram silk blouse from excessive induced wrinkles during a cleaning cycle. All grades of the wrinkled appearance of a garment were made by comparing the test garments with three dimensional crease appearance replicas as in AATCC Test Number 88 C, having a grading scale from 1 to 5. A garment with a grade of 1 would appear excessively wrinkled while a garment with a grade of 5 would appear very smooth and unwrinkled. Before a test garment was inserted into a containment bag, it was pressed so that it would have a wrinkle grade between 4 and 5. The garment was then given a wrinkle grade and inserted into the containment bag. The containment bag with the test garment was run through a 30 minute high heat cycle. At the end of the cycle, the garment was removed from the containment bag and hung in a room with the crease replicas. After five minutes, a final grade was given to the test garment.

For the inherently flat bag, if sufficient effort was used to shape the bag into a nearly spherical shape before running the dryer cleaning cycle, the garment (a 40–60 gram silk blouse), when removed, typically had a change in wrinkle grade of less than 0.5. If the bag containing the garment was placed into the dryer reasonably flattened (as it would be in ordinary use, unless special efforts were made to shape the bag), the test garment would have a reduction in wrinkle grade of nearly 2 levels. In other words, the garment would go into the containment bag with a pressed appearance and have some very hard wrinkles set into it at the end of the cycle.

The tetrahedral-shaped bag, whether inserted into the dryer intentionally collapsed (requiring special efforts, because the normal state of the closed bag is three-dimensional, with considerable tumbling volume) or in its normally open state (but with no special efforts to shape the bag), protected the test garments from excessive, induced wrinkles: the change in wrinkle grade for the garments refreshed in the tetrahedral containment bag was typically less than 0.5.

In light of the foregoing description of selected preferred embodiments, it is understood that certain variations in, departures from, and modifications to those embodiments may become apparent to those skilled in the art without departing from the spirit and scope of the invention defined by the following claims, and equivalents thereto.

We claim:

1. An inherently two-dimensional containment bag for articles to be cleaned in a textile cleaning process, said cleaning process being comprised of placing articles to be cleaned into said bag through an opening having a closure means, securing said closure means, and subjecting said articles within said bag to a tumbling action in the presence of a cleaning agent, said containment bag being comprised of a sheet material having a minimum average Kawabata stiffness value of at least about 0.6 gins (force) $cm^2$/cm. and a maximum average Kawabata stiffness value of about 3.0 gins (force) $cm^2$/cm., and wherein the interior surface of said bag has a maximum average Kawabata surface friction value of about 0.35.

2. The bag of claim 1 wherein said sheet material has a minimum average Kawabata stiffness value of at least about 0.7 gins (force) $cm^2$/cm. and a maximum average Kawabata stiffness value of about 2.0 gins (force) $cm^2$/cm.

3. The bag of claim 2 wherein the interior surface of said bag has a maximum average Kawabata surface friction value of about 0.25.

4. The bag of claim 1 wherein said sheet material has a minimum average Kawabata stiffness value of at least about 0.8 gins (force) $cm^2$/cm. and a maximum average Kawabata stiffness value of about 1.6 gins (force) $cm^2$/cm., and wherein the interior surface of said bag has a maximum average Kawabata surface friction value of about 0.35.

5. The bag of claim 4 wherein the interior surface of said bag has a maximum average Kawabata surface friction value of about 0.30.

6. The bag of claim 4 wherein the interior surface of said bag has a maximum average Kawabata surface friction value of about 0.25.

7. The bag of claim 1 wherein said closure means is a zipper.

8. The bag of claim 1 wherein said bag has sufficient inherent structural rigidity to maintain, during said cleaning process, a free tumbling volume within said enclosed space.

9. The bag of claim 8 wherein said bag has bag walls that contribute to said inherent structural rigidity, said bag walls being comprised of a fabric composite, said composite comprising a textile substrate having a polymer facing.

10. The bag of claim 9 wherein said bag is in a geometric shape having at least one corner area, and wherein said corner area has been truncated along a line extending across said corner area, whereby said articles placed in said bag are prevented from occupying said corner area.

11. An inherently three-dimensional containment bag for articles to be cleaned in a non-immersion textile cleaning process, said bag having sufficient inherent structural rigidity to be substantially self-supporting, said bag being comprised of at least two panels, said panels being joined along at least one seam, said seam forming a rigidifying wall discontinuity, wherein said bag is comprised of two panels and a closure means, wherein said bag, when empty and with said closure means disengaged, is in the form of a flat bag having a closed bottom and an open top, said bag being characterized by having a first seam extending across the width of said bag and forming said closed bottom of said bag, and further having a second seam and a third seam, said second and said third seams being substantially parallel to each other and each being substantially perpendicular to said first seam and extending from a respective point that is located within a substantially central region along the length of said first seam in the direction of said open top.

12. The bag of claim 11 wherein said second and third seams in said flat bag are substantially coincident and extend to said open top, said open top being formed by said disengaged closure means.

13. The bag of claim 11 wherein said second and third seams in said flat bag are parallel but spaced apart a predetermined distance along the length of said first seam.

14. The bag of claim 11 wherein said seams and said closure means, when said closure means is engaged, are sufficiently stiff to allow said bag, when empty, to assume a substantially self-supporting, three-dimensional shape.

15. The bag of claim 14 wherein, in said three-dimensional shape, the projection of a line coincident with said first seam and a line coincident with said closure means form an angle that is substantially 90 degrees.

16. The bag of claim 14 wherein, in said three-dimensional shape, the projection of a line coincident with said first seam and a line coincident with said closure means form an angle that is at least about 30 degrees.

* * * * *